US010106915B2

(12) United States Patent
Hwang et al.

(10) Patent No.: US 10,106,915 B2
(45) Date of Patent: Oct. 23, 2018

(54) ELECTRO-SPINNING TYPE PATTERN FORMING APPARATUS

(71) Applicant: ANF INC., Suwon-si (KR)

(72) Inventors: Won Tae Hwang, Bucheon-si (KR); Goo Sang Jeong, Bucheon-si (KR); Se Ho Lim, Bucheon-si (KR)

(73) Assignee: ANF INC., Gyeonggi-Do (KR)

( * ) Notice: Subject to any disclaimer, the term of this patent is extended or adjusted under 35 U.S.C. 154(b) by 144 days.

(21) Appl. No.: 15/105,828

(22) PCT Filed: Nov. 7, 2014

(86) PCT No.: PCT/KR2014/010647
§ 371 (c)(1),
(2) Date: Jun. 17, 2016

(87) PCT Pub. No.: WO2015/093730
PCT Pub. Date: Jun. 25, 2015

(65) Prior Publication Data

US 2016/0319465 A1 Nov. 3, 2016

(30) Foreign Application Priority Data

Dec. 18, 2013 (KR) ..... 10-2013-0157772
May 21, 2014 (KR) ..... 10-2014-0060941

(51) Int. Cl.
*D01D 5/00* (2006.01)

(52) U.S. Cl.
CPC ..... *D01D 5/0092* (2013.01); *D01D 5/0061* (2013.01)

(58) Field of Classification Search
CPC ..... D01D 5/0092
See application file for complete search history.

(56) References Cited

U.S. PATENT DOCUMENTS 2,158,415 A * 5/1939 Formhals ..... D01D 5/0076 19/150
3,860,685 A * 1/1975 Nakagawa ..... D01D 5/32 264/168

(Continued)

FOREIGN PATENT DOCUMENTS

JP 5224704 7/2013
KR 100678709 1/2007

(Continued)

OTHER PUBLICATIONS (Bellan, L.M., Craighead, H.G., "Control of an electrospinning jet using electric focusing and jet-steering fields", Journal of Vacuum Science & Technology B: Microelectronics and Nanometer Structures Processing, Measurement, and phenomena 24, 3179 (2006) (Year: 2006).*

(Continued)

*Primary Examiner* — Jason L Lazorcik
(74) *Attorney, Agent, or Firm* — Cantor Colburn LLP

(57) ABSTRACT

Provided is an electro-spinning type pattern forming apparatus. The electro-spinning type pattern forming apparatus includes a nozzle, a stage, and a fiber guide part. The nozzle has a first voltage applied thereto and spins a spinning solution. The stage is disposed below the nozzle to support a substrate on which a pattern is to be formed and has a second voltage applied thereto. The fiber guide part is disposed between the nozzle and the stage, and transforms the electric field formed between the nozzle and the stage to apply a force, acting in a direction parallel to the stage, to nano-fibers spun from the nozzle. The electro-spinning type pattern forming apparatus can form a nano-fiber pattern arranged in one direction.

12 Claims, 20 Drawing Sheets

(56) References Cited

U.S. PATENT DOCUMENTS

2006/0138710 A1* 6/2006 Bryner ..... D01D 5/0092 264/464
2006/0138711 A1* 6/2006 Bryner ..... D01D 5/0092 264/465
2007/0040305 A1* 2/2007 Armantrout ..... D01D 5/0092 264/465
2007/0042069 A1* 2/2007 Armantrout ..... D01D 5/0061 425/174.8 R
2008/0258351 A1* 10/2008 Shieh ..... D01D 5/0092 264/466
2009/0152773 A1* 6/2009 Barinov ..... D01D 5/0092 264/465
2010/0173035 A1* 7/2010 Shieh ..... D01D 5/0092 425/174.8 E
2010/0222771 A1* 9/2010 Mitchell ..... A61L 27/14 606/1
2010/0311943 A1* 12/2010 Lallave Rivas ..... C08L 97/005 528/486
2013/0095252 A1* 4/2013 Leschkies ..... D01D 5/0092 427/472
2013/0233245 A1* 9/2013 Chae ..... B05B 5/087 118/624
2015/0275399 A1* 10/2015 Kodama ..... D01D 5/0061 264/465
2016/0068998 A1* 3/2016 Naka ..... D01D 5/0092 264/10
2016/0068999 A1* 3/2016 Yang ..... D01D 5/0023 264/465
2016/0222546 A1* 8/2016 Hino ..... D01D 5/0084
2016/0229104 A1* 8/2016 Mouthuy ..... D01D 5/0076
2016/0361270 A1* 12/2016 Stoddard ..... A61K 9/70

FOREIGN PATENT DOCUMENTS

KR 20130039176 4/2013
WO 9119034 12/1991

OTHER PUBLICATIONS

Teo (Teo, W.-E., Inai, R., Ramakrishna, S., "Technoogical advances in electrospinning of nanofibers", Science and Technology of Advanced Materials, vol. 12, No. 1, (2011)) (Year: 2011).*
International Search Report—PCT/KR2014/010647 dated Feb. 2, 2015.

* cited by examiner

Z-component Electric field Comparison -1

(Color range 0~50000)

Z-component Electric field Comparison -2 (1)

(Color range 0~30000)

ELECTRO-SPINNING TYPE PATTERN FORMING APPARATUS

TECHNICAL FIELD

The following disclosure relates to an apparatus for forming a certain pattern by spinning nano-fiber in an electro-spinning manner.

BACKGROUND ART

As methods for manufacturing nano-fibers, drawing, template synthesis, phase separation, self assembly, and electro-spinning are known. Among these methods, the electro-spinning method is being generally applied to continuously manufacture nano-fiber.

In the electro-spinning method, a high voltage is applied between a nozzle spinning a spinning solution and a stage on which a substrate is disposed, forming an electric field larger than the surface tension of the spinning solution and thus allowing the spinning solution to be spun in a form of nano-fiber. Nano-fibers manufactured by the electro-spinning method are affected by the material properties such as viscosity, elasticity, conductivity, dielectric property, polarity, and surface tension of the spinning solution, the intensity of electric field, and the distance between a nozzle and an integrated electrode.

The method of forming a nano-fiber by electro-spinning is a well-known technology. Meanwhile, there are many attempts to arrange nano-fibers, formed as described above, in a desired direction. Representative examples thereof include a method of obtaining arranged nano-fibers by performing electro-spinning on electrodes formed adjacent to each other and a method of arranging nano-fibers at desired locations by maintaining a distance between a nozzle and a substrate at a very close location. However, these methods have limitations in terms of commercialization.

DISCLOSURE

Technical Problem

Accordingly, the present disclosure provides an electro-spinning type pattern forming apparatus which can arrange nano-fibers in one direction and thus can accurately form a fine pattern.

Technical Solution

In one general aspect, an electro-spinning type pattern forming apparatus includes: a nozzle having a first voltage applied thereto and spinning a spinning solution; a stage disposed under the nozzle to support a substrate on which a pattern is to be formed and having a second voltage applied thereto; and a fiber guide part disposed between the nozzle and the stage and transforming an electric field formed between the nozzle and the stage to apply a force, acting in a direction parallel to the stage, to a nano-fiber spun from the nozzle, wherein the fiber guide part includes first and second guide parts which are symmetrically disposed based on a virtual extension line extending in a vertical direction from an end portion of the nozzle to the stage and extend in a direction perpendicular to the extension line, and the first and second guide parts are formed of a material having a relative dielectric permittivity of 50 or less.

For example, the first and second guide parts may be formed of polystyrene (e.g., Styrofoam), polytetrafluoroethylene (e.g., Teflon), wood, plastics, glass, quartz, and silicon oxide.

A distance between the end portion of the nozzle and a virtual surface where upper surfaces of the first and second guide parts are located may be equal to or smaller than a distance between the end portion of the nozzle and a point where a nano-fiber is formed from a Taylor cone having a conic shape formed at the end portion of the nozzle.

The first and second guide parts may have a thickness larger than about 5 mm in the extension line direction, respectively. For example, the first and second guide parts may have a thickness equal to or larger than about 10 mm, respectively.

The first and second guide parts may have a thickness ranging from about 10 mm to about 70 mm in the extension direction.

In another general aspect, an electro-spinning type pattern forming apparatus includes: a nozzle having a first voltage applied thereto and spinning a nano-fiber from a spinning solution; a stage part disposed under the nozzle to support a substrate on which a pattern is to be formed and having a second voltage different from the first voltage applied thereto; a first nano-fiber guide part including a first guide part and a second guide part spaced from each other across an extension line of the nozzle between the nozzle and the stage part and transforming an electric field formed between the nozzle and the stage part to arrange the nano-fiber in a direction corresponding to a region between the first and second guide parts; and a second nano-fiber guide part including a third guide part and a fourth guide part disposed over the first guide part and the second guide part, respectively, and spaced from each other, and transforming an electric field formed between the nozzle and the stage part to guide the nano-fiber to a region between the first and second guide parts.

The first guide part and the second guide part, and the third guide part and the fourth guide part may extend in a first direction across a virtual extension line extending perpendicularly to the stage part from the nozzle, and may be formed of a material having a relative dielectric permittivity of 50 or less, respectively. For example, the first and second guide parts and the third and fourth guide parts may be formed of one or more selected from a group consisting of polystyrene (e.g., Styrofoam), polytetrafluoroethylene (e.g., Teflon), wood, plastics, glass, quartz, silicon oxide, and metal.

Upper surfaces of the first and second guide parts and lower surfaces of the third and fourth guide parts may make contact with each other or may be spaced from each other by a gap of about 10 mm or less.

A first distance between the first guide part and the second guide part may be smaller than a second distance between the third guide part and the fourth guide part. For example, the second distance may be larger about 4/3 times to about 8/3 times than the first distance.

The electro-spinning type pattern forming apparatus may further include a first position control part moving the first nano-fiber guide part in up-and-down and left-and-right directions and a second position control part moving the second nano-fiber guide part in up-and-down and left-and-right directions independently of the first nano-fiber guide part.

Other features and aspects will be apparent from the following detailed description, the drawings, and the claims.

Advantageous Effects

According to the embodiments, since a force acting in one direction can be applied to nano-fibers by transforming an electric field between a nozzle and a stage using a fiber guide part formed of a material having a low relative dielectric constant, nano-fibers can be arranged and located in one direction on a substrate, thereby forming a microscale pattern at a predetermined location on the substrate.

Also, a microscale pattern can be accurately formed on a substrate more stably by guiding nano-fibers to a region between first guide part and a second guide part of a first nano-fiber guide part using a second nano-fiber guide part formed of a material having a low relative dielectric constant and disposed over the first nano-fiber guide part.

BEST MODE

Figure 1:
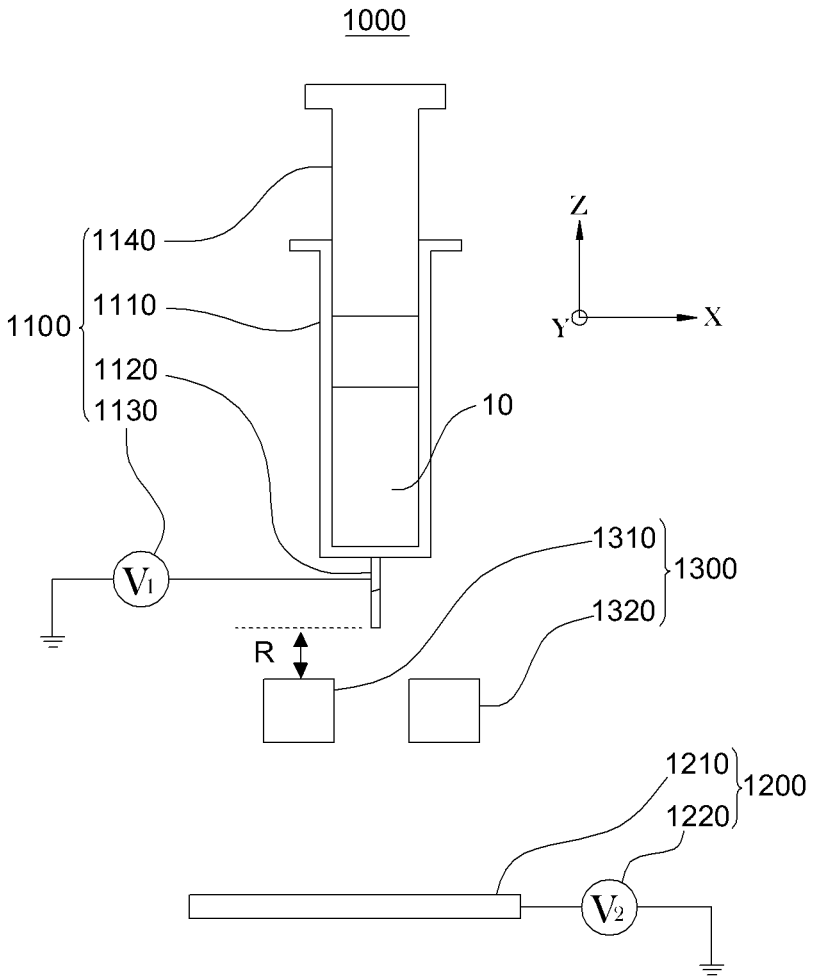
FIG. 1 is a conceptual view illustrating an electro-spinning type pattern forming apparatus according to an embodiment of the present invention.

Hereinafter, exemplary embodiments of the present invention will be described in detail with reference to the accompanying drawings. Since the present invention can be modified into various types, exemplary embodiments will be illustrated in the drawings and described in this disclosure in detail. However, the present invention is not limited to a specific disclosure type, but should be construed as including all modifications, equivalents, substitutes involved in the scope and the technological range of the present invention. Like reference numerals are used for referring to the same or similar elements in the description and drawings. In the accompanying drawings, the dimensions of structures are scaled up or down compared to their actual sizes for clarity of the present invention.

In the following description, the technical terms are used only for explaining specific embodiments while not limiting the present invention. The terms of a singular form may include plural forms unless referred to the contrary. In this disclosure, the terms "include," "comprise," or "have" specifies features, numbers, steps, operations, elements or combinations thereof, but do not exclude existence or addition possibility of one or more other features, numbers, steps, operations, elements or combinations thereof.

Unless described otherwise, all terms used herein including technical or scientific terms may include the same meaning as those generally understood by persons skilled in the art to which the present invention belongs. Terms as defined in dictionaries generally used should be construed as including meanings which accord with the contextual meanings of related technology. Also, unless clearly defined in this disclosure, the terms should not be construed as having ideal or excessively formal meanings.

FIG. 1 is a conceptual view illustrating an electro-spinning type pattern forming apparatus according to an embodiment of the present invention.

Referring to FIG. 1, an electro-spinning type pattern forming apparatus 1000 according to an embodiment of the present invention may directly form a fine pattern on a substrate (not shown) by electro-spinning a spinning solution 10. To this end, the electro-spinning type pattern forming apparatus 1000 may include a solution spinning part 1100, a stage part 1200, and a fiber guide part 1300.

The solution spinning part 1100 may include a syringe 1110, a nozzle 1120, and a first voltage generator 1130.

The syringe 1110 may contain a spinning solution 10. The spinning solution 10 may be an organic material solution such as polymer or an organic/inorganic mixed solution in which organic and inorganic materials are mixed, and may have a viscosity of about 1 poise to about 200 poise. The nozzle 1120 may be connected to the syringe 1110, and may spin the spinning solution 10, contained in the syringe 1110, in a direction of a stage 1210. The nozzle 1120 may be formed of a conductive material, for example, a stainless material, and may have a fine tubular shape with a certain inner diameter and a certain outer diameter. The first voltage generator 1130 may be electrically connected to the nozzle 1120, and may apply a first voltage to the nozzle 1120. For example, the first voltage generator 1130 may generate a DC voltage having positive polarity and may apply the DC voltage to the nozzle 1120. The magnitude of the first voltage applied to the nozzle 1120 may be appropriately adjusted as needed. In an embodiment, the solution spinning part 110 may further include a syringe pump 1140. The syringe pump 1140 may apply pressure to the spinning solution 10 contained in the syringe 1110 such that the spinning solution 10 contained in the syringe 1110 can be discharged out of the nozzle 1120.

The stage part 1200 may include a stage 1210 and a second voltage generator 1220.

The stage 1210 may be disposed so as to be spaced, by a certain gap, from an end portion of the nozzle 1120 from which the spinning solution 10 is spun. The stage 1210 may be formed of a conductive material. A substrate (not shown) on which a pattern is to be formed may be disposed over the stage 1210. The second voltage generator 1220 may be electrically connected to the stage 1210, and may generate a second voltage different from the first voltage applied to the nozzle 1120 and apply the second voltage to the stage 1210. For example, the second voltage generator 1220 may generate and apply a ground voltage to the stage 1210. On the other hand, the second voltage generator 1220 may also generate a negative voltage having different polarity from the first voltage or a positive voltage having different intensity from the first voltage, and may apply the negative voltage or the positive voltage to the stage 1210.

Since different voltages are applied to the nozzle 1120 and the stage 1210, an electric field may be generated between the nozzle 1120 and the stage 1210 due to a voltage difference. When an electric field is not formed between the nozzle 1120 and the stage 1210, the spinning solution 10 distributed to the end of the nozzle 1120 may be suspended from the end of the nozzle 1120 in a form of hemispherical drop by the surface tension. However, when an electric field is formed between the nozzle 1120 and the stage 1210, electric charges having an opposite polarity to the voltage applied to the nozzle 1120 may be induced on the surface of the drop of the spinning solution 10, and the electric charges induced on the surface of the drop of spinning solution 10 may generate an electrostatic force that is an opposite force to the surface tension. Due to the action of this electrostatic force, the drop of the spinning solution 10 suspended from the end of the nozzle 1120 may elongate into a conical shape that is known as a Taylor cone. When the intensity of the electric field formed between the nozzle 1120 and the stage 1210 becomes larger than the intensity of a specific critical electric field, a jet of the spinning solution 10 may be discharged from the end of the Taylor cone of the spinning solution 10. When the viscosity of the spinning solution 10 is low, the jet of the spinning solution 10 may collapse into fine drops. However, when the viscosity of the spinning solution 10 is high, the jet of the spinning solution 10 may not collapse due to the surface tension, and may be spun in a direction of stage 1210 in a form of continuous fiber. In this embodiment, since the spinning solution 10 has a viscosity of about 1 poise to about 200 poise, the spinning solution 10 may be spun in a form of fiber. The fiber of the spinning solution 10 discharged from the Taylor cone of the spinning solution 10 may have a diameter of nanoscale. Hereinafter, 'the fiber of the spinning solution 10' discharged from the Taylor cone of the spinning solution 10 will be referred to as a 'nano-fiber' for convenience of explanation.

The fiber guide part 1300 may guide the travel direction of the nano-fiber spun from the nozzle 1120. For this, the fiber guide part 1300 may include a first guide part 1310 and a second guide part 1320. The first and second guide parts 1310 and 1320 may be disposed between the stage 1210 and the end portion of the nozzle 1120 from which a nano-fiber is spun, and may extend in a direction Y. Also, the first and second guide parts 1310 and 1320 may be parallel to each other and may be spaced from each other by a certain gap across an extension line of the nozzle 1120. The first and second guide parts 1310 and 1320 may not be limited to a specific shape, and may have various kinds of shapes. For example, the first and second guide parts 1310 and 1320 may have a rodlike shape having a section of circle, polygon, semi-circle and oval, and may also have a plate shape. As an example, the first and second guide parts 1310 and 1320 may have a rodlike shape which has a rectangular section perpendicular to the stage 1210 and extends in a direction Y parallel to the stage 1210, respectively.

In an embodiment, the first and second guide parts 1310 and 1320 may be formed of a material which can transform an electric field formed between the nozzle 1120 and the stage 1210. As an example, the first and second guide parts 1310 and 1320 may be formed of a material having a low relative dielectric permittivity. For example, the first and second guide parts 1310 and 1320 may be formed of a material having a relative dielectric permittivity of about 50 or less. Specifically, the first and second guide parts 1310 and 1320 may be formed of a material such as polystyrene (e.g., Styrofoam), polytetrafluoroethylene (e.g., Teflon), wood, plastics, glass, quartz, and silicon oxide, but the present invention is not limited thereto. As another example, the first and second guide parts 1310 and 1320 may be formed of a metallic material.

Figure 2:
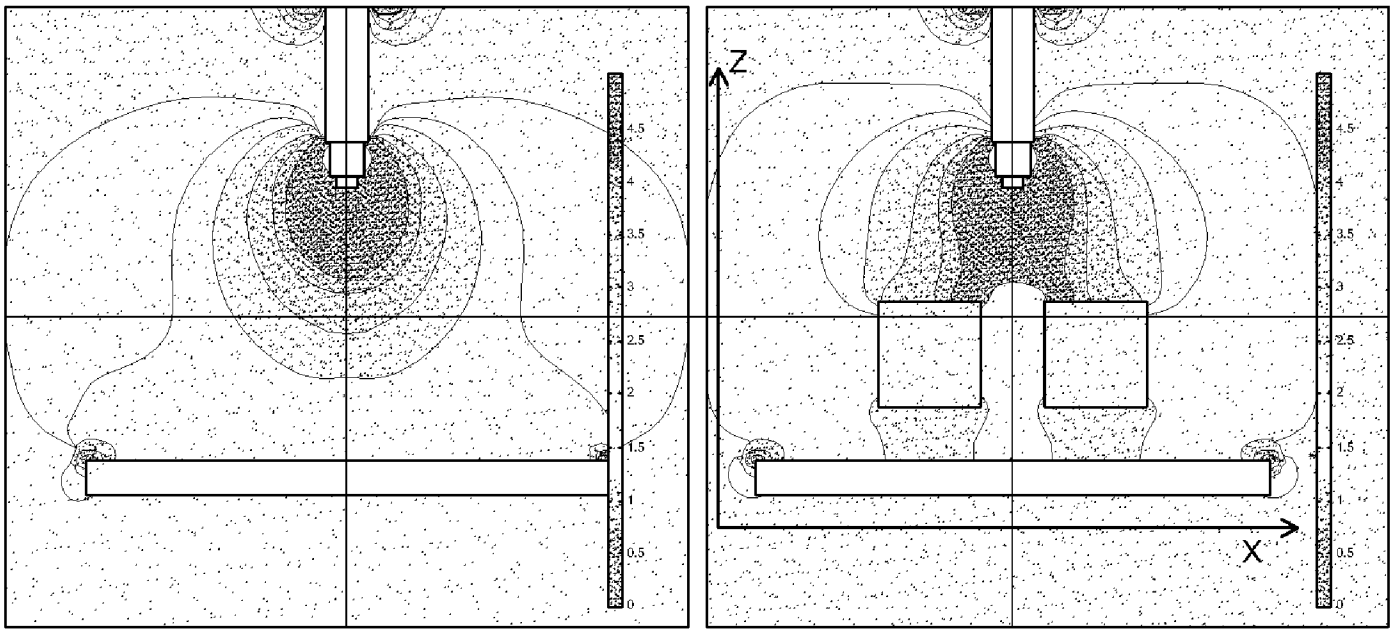
FIG. 2 is a view illustrating the intensity of a Z-component electric field according to the position of X-axis in a typical electro-spinning type pattern forming apparatus without a fiber guide part and an electro-spinning type pattern forming apparatus with a fiber guide part according to an embodiment of the present invention.
Figure 3:
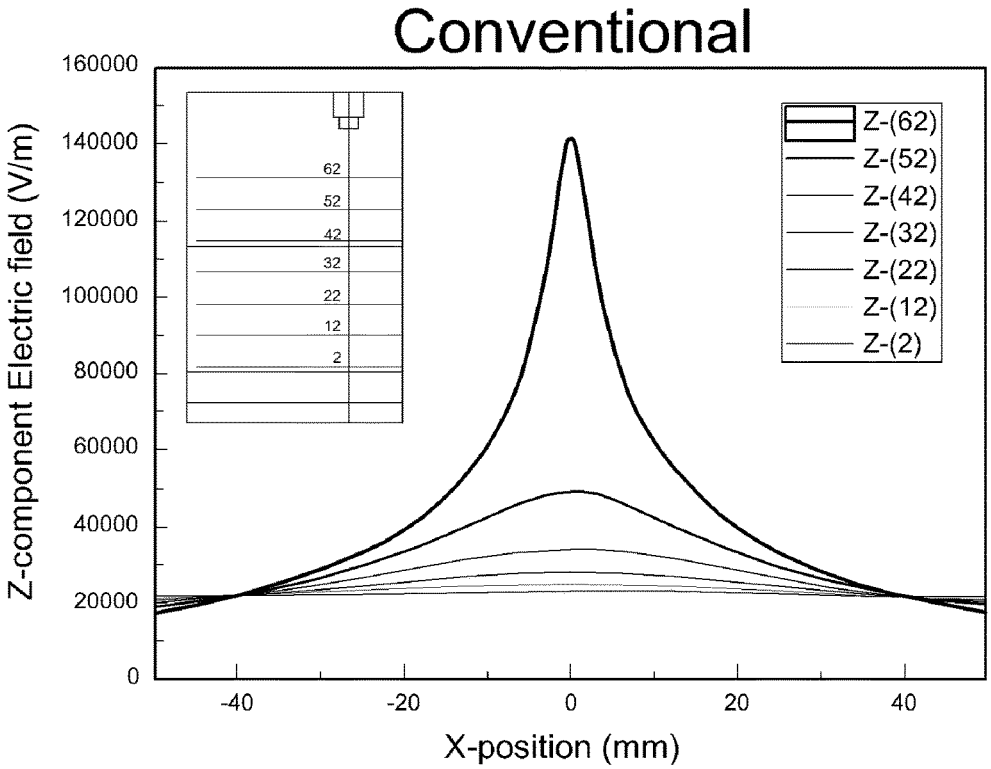
FIG. 3 is a graph illustrating the intensities of Z-component electric fields according to the positions of X-axis in a typical electro-spinning type pattern forming apparatus.
Figure 4:
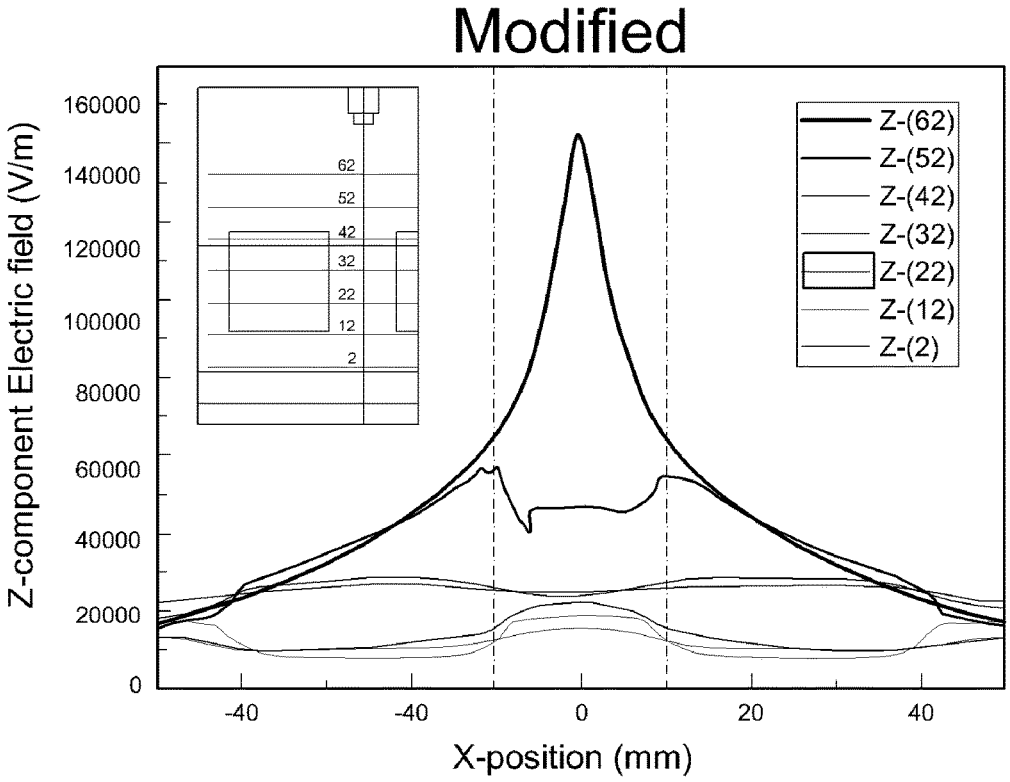
FIG. 4 is a graph illustrating the intensities of Z-component electric fields according to the positions of X-axis in an electro-spinning type pattern forming apparatus according to an embodiment of the present invention.
Figure 5:
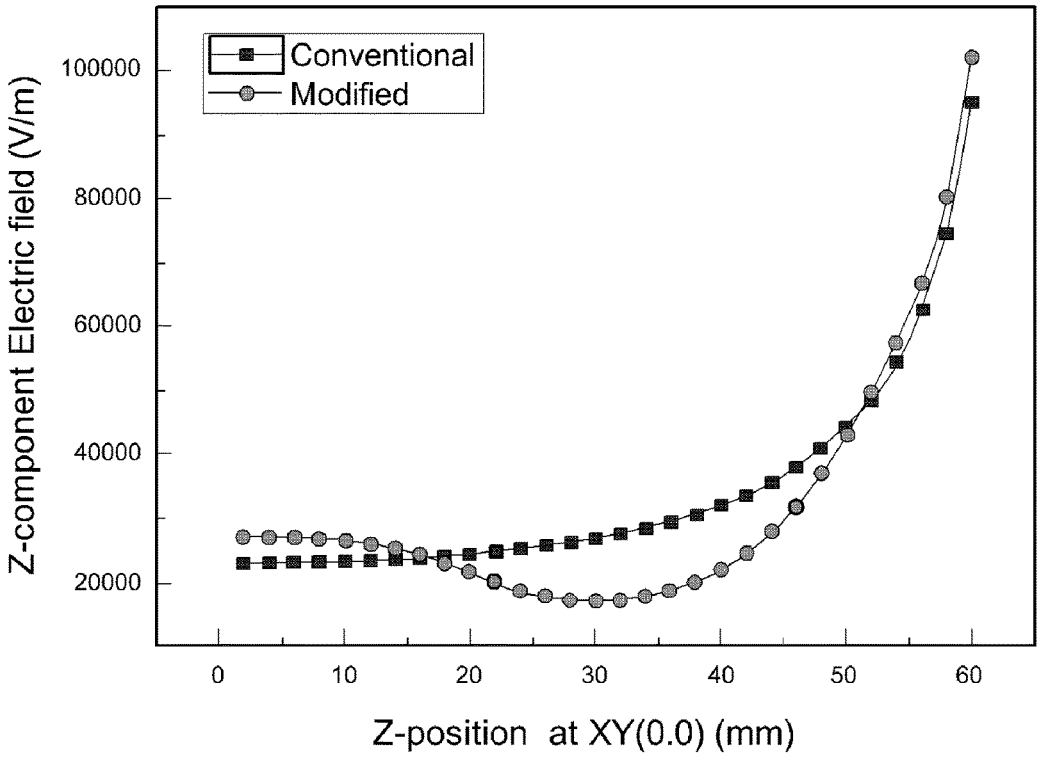
FIG. 5 is a view illustrating the intensity of a Z-component electric field according to the position of Z-axis at a point where both X-coordinate and Y-coordinate are zero, in a typical electro-spinning type pattern forming apparatus and an electro-spinning type pattern forming apparatus according to an embodiment of the present invention.

FIG. 2 is photographs illustrating the intensity of a Z-component electric field according to the position of X-axis in a typical electro-spinning type pattern forming apparatus without a fiber guide part and an electro-spinning type pattern forming apparatus with a fiber guide part according to an embodiment of the present invention. FIG. 3 is a graph illustrating the intensities of Z-component electric fields according to the positions of X-axis in a typical electro-spinning type pattern forming apparatus. FIG. 4 is a graph illustrating the intensities of Z-component electric fields according to the positions of X-axis in an electro-spinning type pattern forming apparatus according to an embodiment of the present invention. FIG. 5 is a view illustrating the intensity of a Z-component electric field according to the position of Z-axis at a point where both X-coordinate and Y-coordinate are zero, in a typical electro-spinning type pattern forming apparatus and an electro-spinning type pattern forming apparatus according to an embodiment of the present invention. In FIGS. 3 and 4, 'Z-(2) curve', 'Z-(12) curve', 'Z-(12) curve', 'Z-(32) curve', 'Z-(42) curve', 'Z-(52) curve' 빛 'Z-(62) curve' indicate the intensities of Z component electric field at points where Z-coordinates are '2', '12', '22', '32', '42', '52' and '62', respectively.

The X-axis indicates a direction perpendicular to the Y-axis direction that is parallel to the stage 1210 and is an extension direction of the first and second guide parts, and the Z-axis indicates a direction perpendicular to the X-axis and Z-axis.

A point where X-coordinate is zero may indicate a point where the extension line of the nozzle 1120 is located, and a point where Y-coordinate is zero may also indicate a point where the extension line of the nozzle 1120 is located. On the other hand, a point where Z-coordinate is zero may indicate a point located on the surface of the stage 1210.

In an electro-spinning type pattern forming apparatus according to an embodiment of the present invention, the first and second guide parts may be symmetrically disposed based on the extension line of the nozzle, and may have a cuboidal shape in which the length of Y-axis is about 50 mm, the width of X-axis is about 30 mm and the thickness of Z-axis is about 30 mm. The distance between the first guide part and the second guide part may be about 20 mm, and Z-coordinates of the upper surfaces and the lower surfaces of the first and second guide parts may be '45' and '15', respectively.

Referring to FIGS. 2 to 5, in a typical electro-spinning type pattern forming apparatus, as the distance from the end portion of the nozzle increases, i.e., as the Z-coordinate decreases, the intensity of the electric field may continuously decrease. When the Z-coordinates are the same, the intensity of the electric field is largest at a point where the X-coordinate is zero. Also, as the distance from the point where the X-coordinate is zero increases, the intensity of the electric field may be reduced.

On the contrary, in an electro-spinning type pattern forming apparatus according to an embodiment of the present invention, 'Z-(22) curve', 'Z-(32) curve', and 'Z-(42) curve' with respect to points where Z-coordinates are located between '+15' and '+45', i.e., between two guide parts may indicate smaller intensities of the electric field than 'Z-(12)' and 'Z-(2)' with respect to points where Z-coordinates are smaller than '+15'. Accordingly, a nano-fiber passing between the first and second guide parts may be changed in its travel direction even by a small force acting in X-axis direction or Y-axis direction.

In an electro-spinning type pattern forming apparatus according to an embodiment of the present invention, in case of 'Z-(22) curve', 'Z-(32) curve', and 'Z-(42) curve which are located between the first and second guide parts, the intensity of electric field of a space between the first and second guide parts, i.e., where X-coordinate is between '−10' and '+10' may be largest, and the intensity of electric field of internal spaces of the first and second guide parts, i.e., where X-coordinate is between '−40' and '−10' and between '+10' and '+40' may be smallest. Accordingly, when a charged nano-fiber discharged from droplet Taylor cone passes between the first and second guide parts, the nano-fiber may be affected by a force arranging X-coordinate so as to be zero.

However, in case of 'Z-(52) curve' of FIG. 4 which indicates the intensity of electric field at a point located just over the upper surface of the first and second guide parts, due to influences of the edges of first and second guide parts, the intensity of electric field at a region where X-coordinate is between '−8' and '+8' may be smaller than the intensity of electric field at an adjacent point where X-coordinate is between '−10' and '+10'. However, Z-coordinate '52' may be a point where the jet of the spinning solution from the droplet Taylor cone starts to form. Accordingly, since the jet of spinning solution has a sufficient diameter, the jet of spinning solution may be little influenced by the electric field even though the intensity of electric field is relatively large at the points where X-coordinate is '−10' and '+10'.

Figure 6:
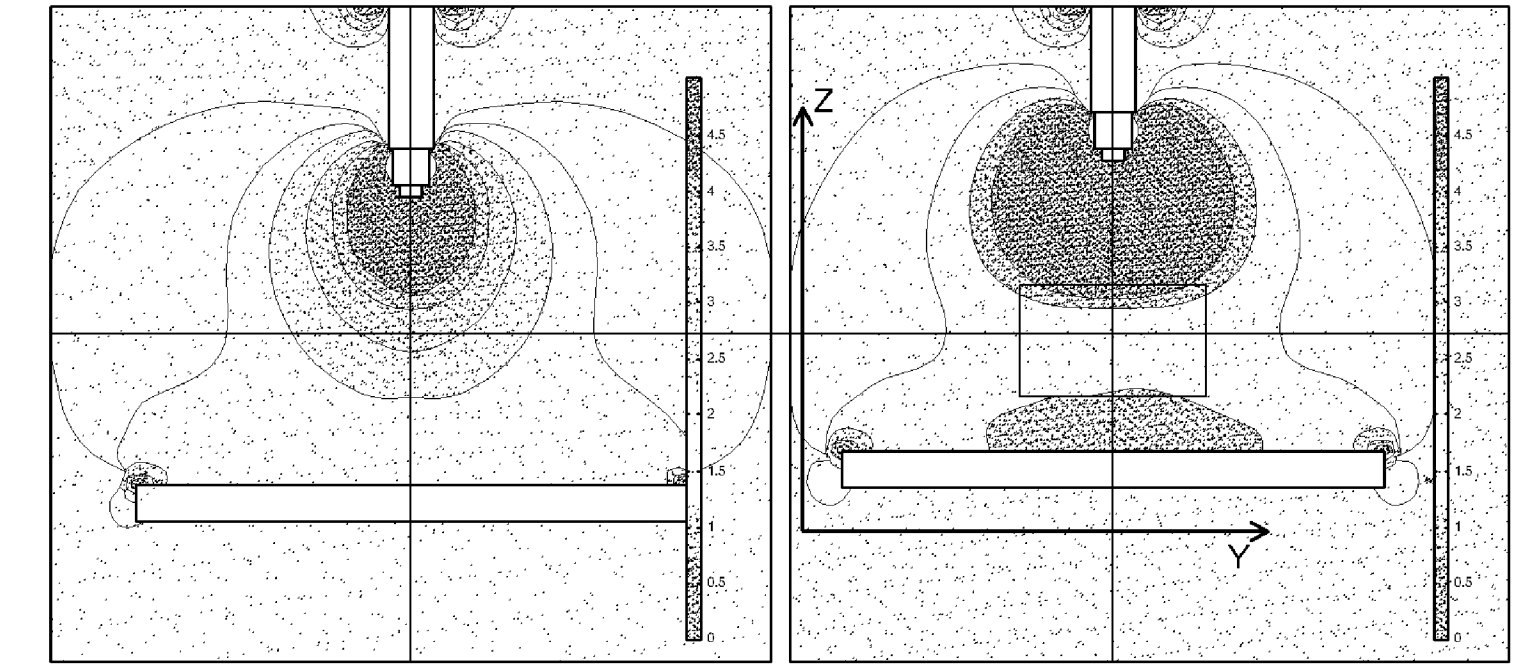
FIG. 6 is a graph illustrating the intensity of a Z-component electric field according to the position of Y-axis in a typical electro-spinning type pattern forming apparatus and an electro-spinning type pattern forming apparatus according to an embodiment of the present invention.
Figure 7:
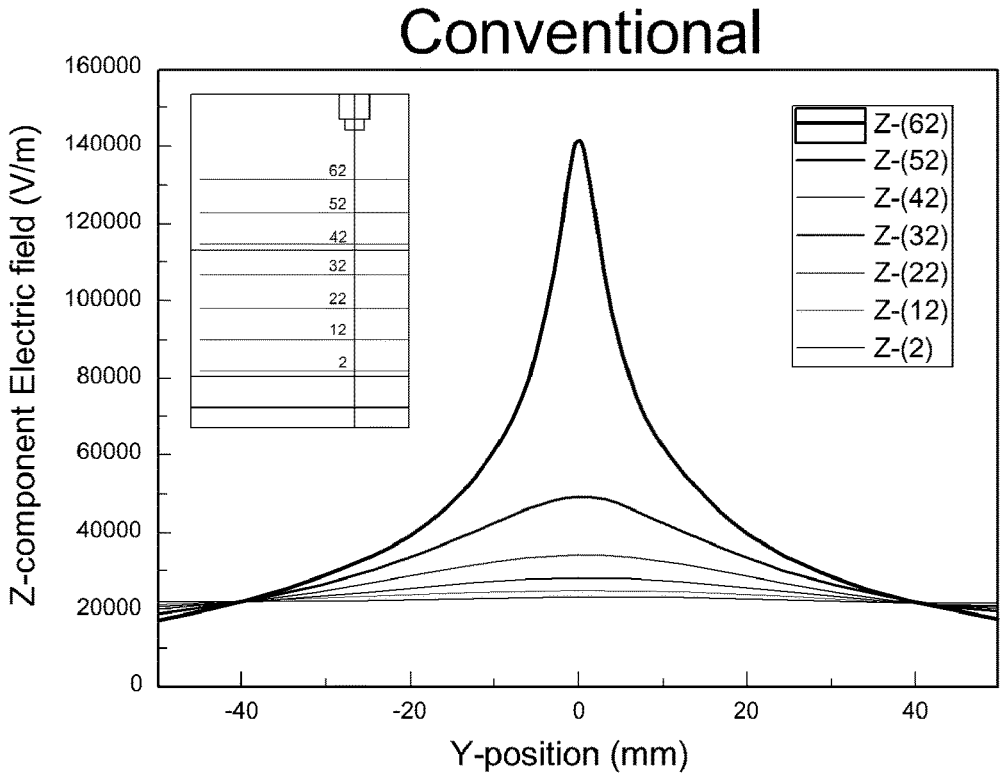
FIG. 7 is a graph illustrating the intensities of Z-component electric fields according to the positions of Y-axis in a typical electro-spinning type pattern forming apparatus.
Figure 8:
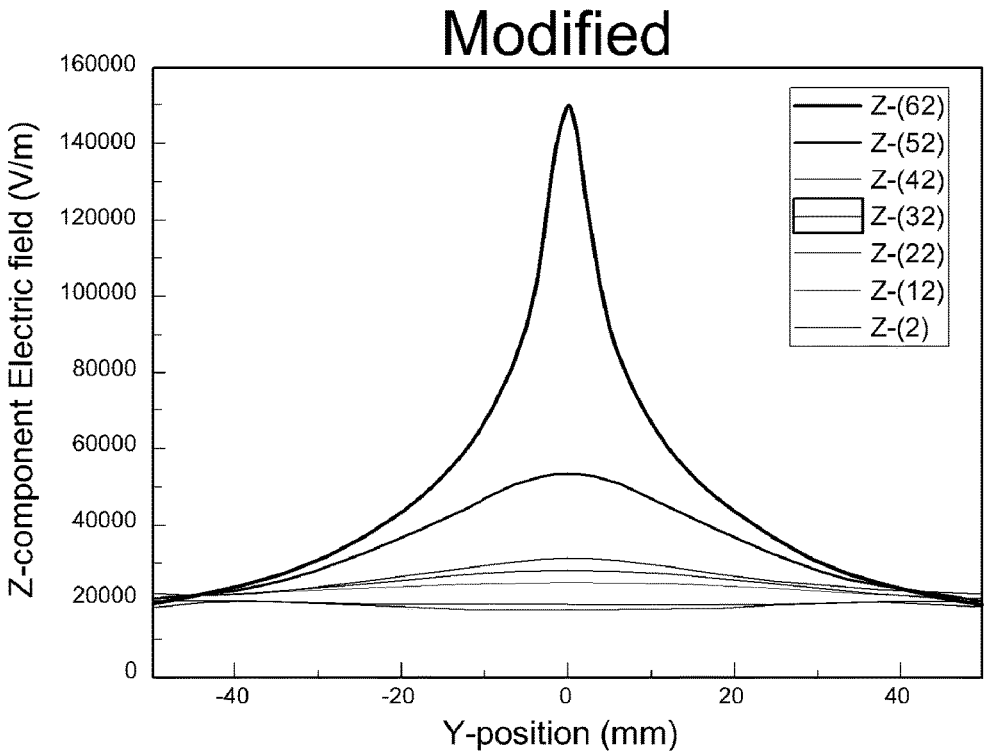
FIG. 8 is a graph illustrating the intensities of Z-component electric fields according to the positions of Y-axis in an electro-spinning type pattern forming apparatus according to an embodiment of the present invention.
Figure 9:
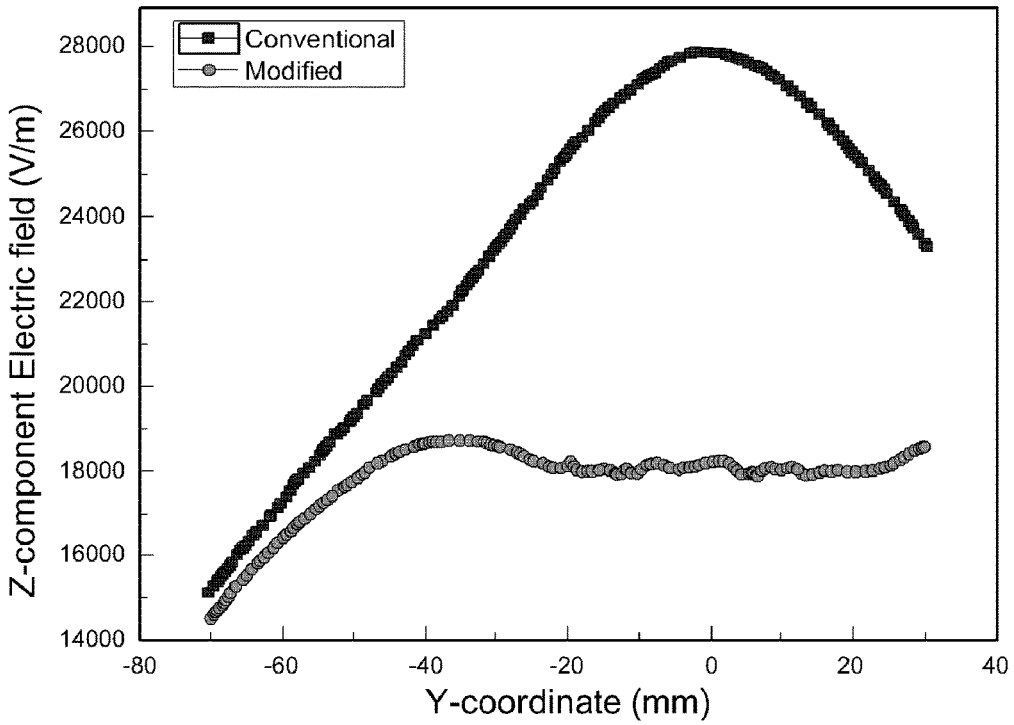
FIG. 9 is a graph illustrating the intensity of a Z-component electric field according to the position of Y-axis at a point where X-coordinate is zero and Z-coordinate is 30, in a typical electro-spinning type pattern forming apparatus and an electro-spinning type pattern forming apparatus according to an embodiment of the present invention.

FIG. 6 is a graph illustrating the intensity of a Z-component electric field according to the position of Y-axis in a typical electro-spinning type pattern forming apparatus and an electro-spinning type pattern forming apparatus according to an embodiment of the present invention. FIG. 7 is a graph illustrating the intensities of Z-component electric fields according to the positions of Y-axis in a typical electro-spinning type pattern forming apparatus. FIG. 8 is a graph illustrating the intensities of Z-component electric fields according to the positions of Y-axis in an electro-spinning type pattern forming apparatus according to an embodiment of the present invention. FIG. 9 is a graph illustrating the intensity of a Z-component electric field according to the position of Y-axis at a point where X-coordinate is zero and Z-coordinate is 30, in a typical electro-spinning type pattern forming apparatus and an electro-spinning type pattern forming apparatus according to an embodiment of the present invention; In FIGS. 7 and 8, 'Z-(2) curve', 'Z-(12) curve', 'Z-(12) curve', 'Z-(32) curve', 'Z-(42) curve', 'Z-(52) curve' 빛 'Z-(62) curve' indicate the intensities of Z component electric field at points where Z-coordinates are '2', '12', '22', '32', '42', '52' and '62', respectively.

Referring to FIGS. 6 to 9, in a typical electro-spinning type pattern forming apparatus, as the distance from the end portion of the nozzle increases, i.e., as the Z-coordinate decreases, the intensity of the electric field may continuously decrease. When the Z-coordinates are the same, the intensity of the electric field is largest at a point where the Y-coordinate is zero. Also, as the distance from the point where the Y-coordinate is zero increases, the intensity of the electric field may be reduced.

On the contrary, in an electro-spinning type pattern forming apparatus according to an embodiment of the present invention, 'Z-(22) curve' and 'Z-(32) curve' with respect to points where Z-coordinates are located between '+15' and '+45', i.e., between two guide parts may indicate smaller intensities of the electric field than 'Z-(12)' and 'Z-(2)' with respect to points where Z-coordinates are smaller than '+15'. Also, in 'Z-(22) curve' and 'Z-(32) curve', the intensity of electric field at a region where Y-coordinate is between '−25' and '+25', i.e., at a space between first and second guide parts may be smaller than the intensity of electric field at a region where Y-coordinate is smaller than '−25' or larger than '+25'. Particularly, referring to FIG. 9, the electric field at a position where Z-coordinate is '+30' and which is a central point in Z-axis direction of the first and second guide parts may indicate a relatively lower intensity of electric field at the first region where Y-coordinate is between '−20' and '+20'. Also, due to the edges of first and second guide parts, the intensity of electric field at regions where Y-coordinate is between '−40' and '−20 and between '+20' and '+40' (not shown) may increase compared to the first region. Accordingly, the nano-fiber passing between the first and second guide parts may receive a force acting in Y-axis direction by the increased electric field at the region '−40' and '−20' or between '+20' and '+40' (not shown).

In general, since a nano-fiber charged by electro-spinning has a diameter of nanoscale, the solvent of spinning solution may quickly evaporate, and a Coulomb repulsion force may be generated by charges of the nano-fiber, which causes the bending instability of the nano-fiber. Consequently, in a typical electro-spinning type pattern forming apparatus, the nano-fiber may be elongated in a direction where the Coulomb repulsion force is minimized, and thus the nano-fiber may be arranged on a substrate in a random direction. On the other hand, in an electro-spinning type pattern forming apparatus according to an embodiment of the present invention, the first and second guide parts may be disposed around a point where the bending instability of a nano-fiber starts to show, and thus a force acting in one direction of Y-axis directions may be applied to the nano-fiber. Space charges may be formed by a charged nano-fiber which is pulled in one direction of Y-axis directions, and may apply a repulsion force such that a following portion (a portion of the nano-fiber located at a portion relatively adjacent to the nozzle) of the nano-fiber can direct to the opposite direction. When this action repeatedly occurs, the nano-fiber may perform a repeated movement in Y-axis direction. Thus, a nano-fiber arranged in Y-axis direction may be formed on a substrate.

Figure 10:
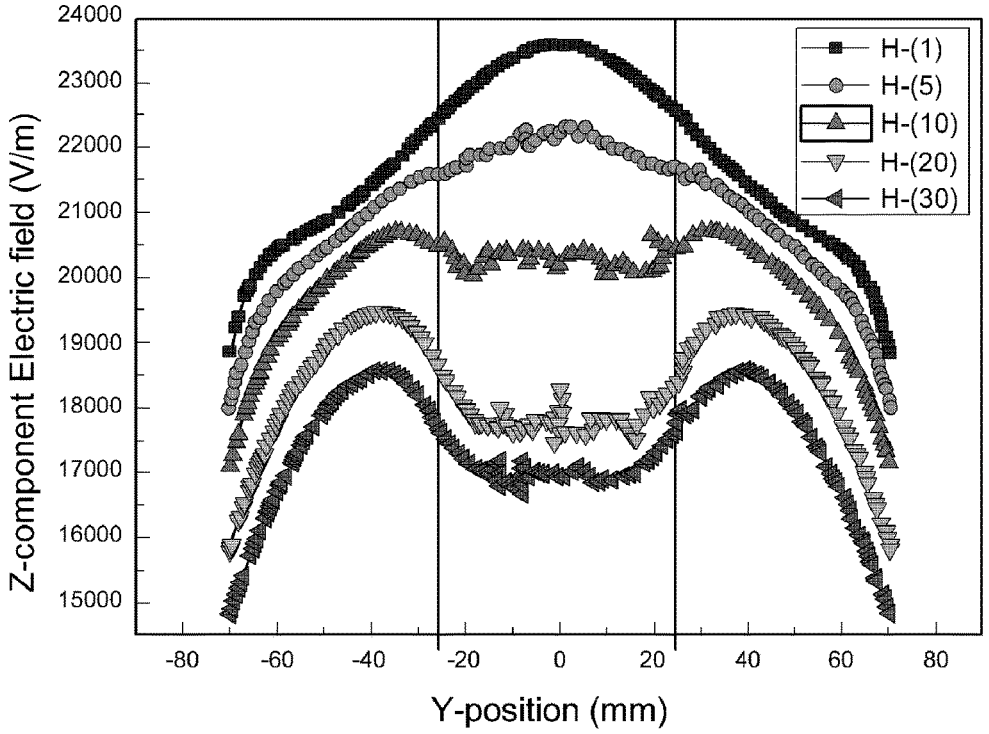
FIG. 10 is a graph illustrating effects of Z-axis thicknesses of first and second guide parts on an electric field in an electro-spinning type pattern forming apparatus according to an embodiment of the present invention.

FIG. 10 is a graph illustrating effects of Z-axis thicknesses of first and second guide parts on an electric field in an electro-spinning type pattern forming apparatus according to an embodiment of the present invention. In FIG. 10, each curve may indicate the intensity of Z-component electric field according to Y-coordinate at a central point between the first and second guide parts, i.e., at a point where Z-coordinate is '30' and X-coordinate is zero. Also, 'H-(1) curve', 'H-(5) curve', 'H-(10) curve', 'H-(20) curve' and 'H-(30) curve' indicate that thicknesses of the first and second guide parts in Z-axis direction are '1 mm', '5 mm', '10 mm', '20 mm' and '30 mm', respectively. In the electro-spinning type pattern forming apparatus according used for measurement of FIG. 10, the first and second guide parts may be symmetrically disposed based on the extension line of the nozzle. Also, the length of Y-axis direction may be about 50 mm and the width of X-axis direction may be about 30 mm. The Z-axis center of the first and second guide parts of first and second guide parts may be located at Z-coordinate '30'.

Referring to FIG. 10, when the thickness of the first and second guide parts is equal to or less than about 5 mm, the intensity of Z-component electric field may be largest at a point where Y-coordinate is zero. Also, as Y-coordinate increases or decreases from zero, the intensity of Z-component electric field may be reduced. In this case, since a force acting in Y-axis direction cannot be applied to a charged nano-fiber, the nano-fiber cannot be arranged in Y-axis direction. Accordingly, the thickness of first and second guide parts may be larger than about 5 mm, and more preferably, may be equal to or larger than about 10 mm.

Figure 11:
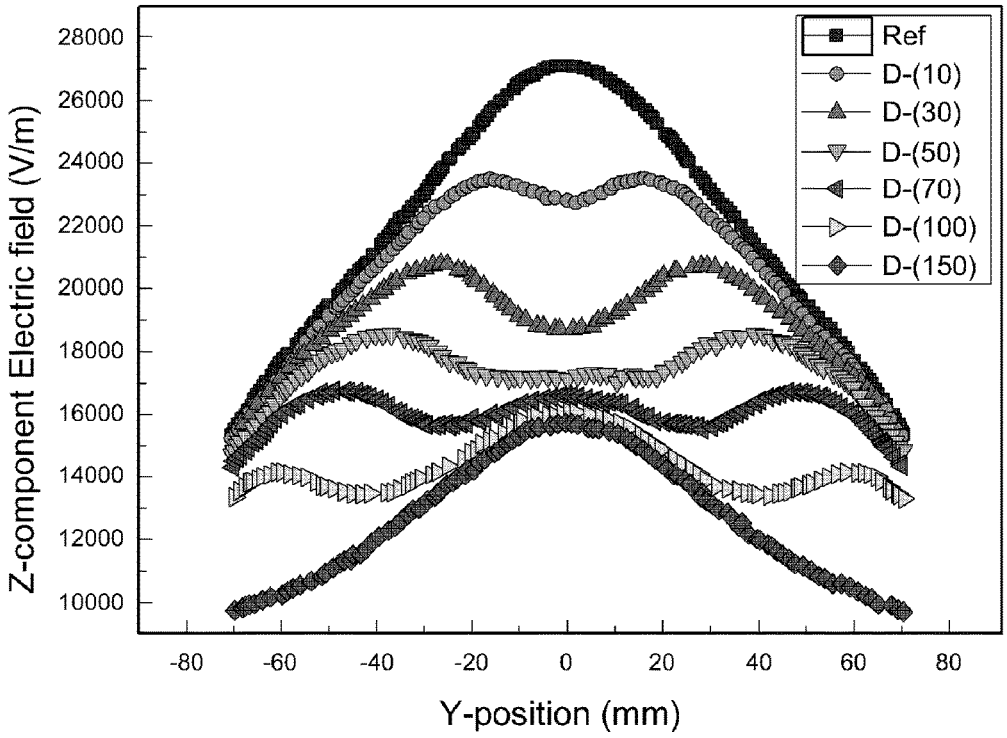
FIG. 11 is a graph illustrating effects of Y-axis lengths of first and second guide parts on an electric field in an electro-spinning type pattern forming apparatus according to an embodiment of the present invention.

FIG. 11 is a graph illustrating effects of Y-axis lengths of first and second guide parts on an electric field in an electro-spinning type pattern forming apparatus according to an embodiment of the present invention. In FIG. 11, each curve may indicate the intensity of Z-component electric field according to Y-coordinate at a central point between the first and second guide parts, i.e., at a point where Z-coordinate is '30' and X-coordinate is zero. Also, 'D-(10) curve', 'D-(30) curve', 'D-(50) curve', 'D-(70) curve', 'D-(100)', and 'D-(150) curve' indicate that Y-axis length of the first and second guide parts are '10 mm', '30 mm', '50 mm', '70 mm', '100 mm', and '150 mm', respectively, and 'Ref curve' indicates there are no first and second guide parts. In the electro-spinning type pattern forming apparatus according used for measurement of FIG. 11, the first and second guide parts may be symmetrically disposed based on the extension line of the nozzle. Also, the thickness of Z-axis direction may be about 30 mm and the width of X-axis direction may be about 30 mm. The Y-axis center of the first and second guide parts of first and second guide parts may be located at Y-coordinate '0'.

Referring to FIG. 11, in regard to 'D-(10) curve', 'D-(30) curve', 'D-(50) curve', and 'D-(70) curve', since the intensity of electric field at an edge region of the first and second guide parts is larger than the intensity of electric field at a region between the first and second guide parts, it can be seen that a force acting in Y-axis direction can be applied to the charged nano-fiber passing between the first and second guide parts. Accordingly, Y-axis length of the first and second guide parts may range from about 10 mm to about 70 mm.

Mode for Invention

Figure 12:
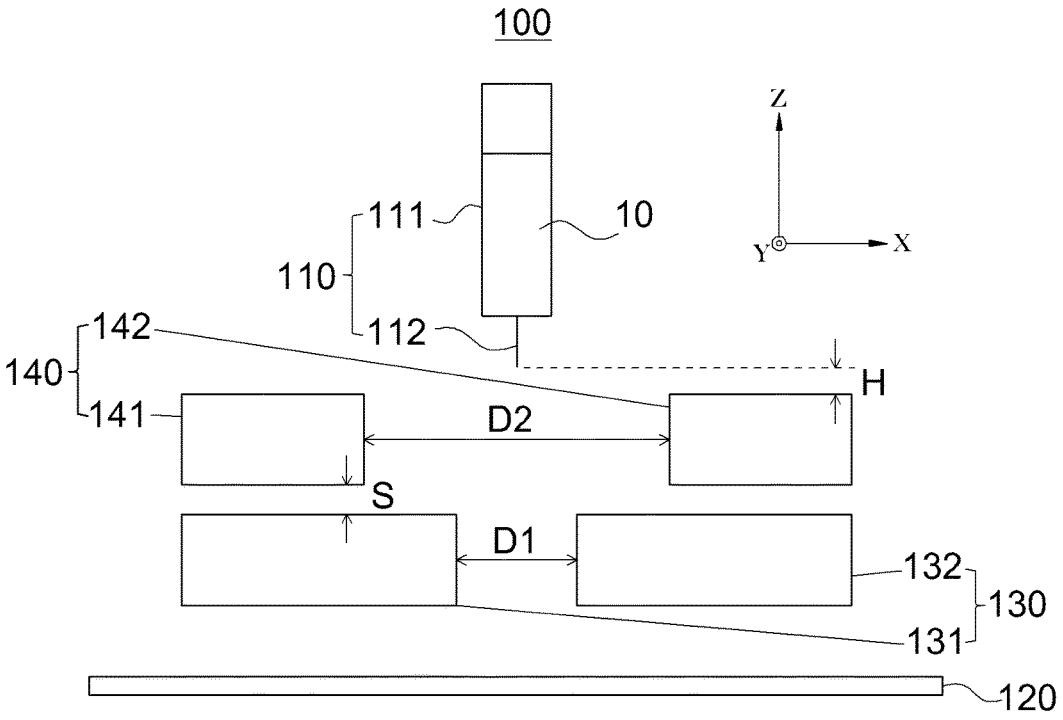
FIG. 12 is a view illustrating an electro-spinning type pattern forming apparatus according to another embodiment of the present invention.

FIG. 12 is a view illustrating an electro-spinning type pattern forming apparatus according to another embodiment of the present invention.

Referring to FIG. 12, an electro-spinning type pattern forming apparatus 100 according to another embodiment of the present invention may directly form a fine pattern on a substrate (not shown) by electro-spinning a spinning solution 10. To this end, the electro-spinning type pattern forming apparatus 100 may include a solution spinning part 110, a stage part 120, a first nano-fiber guide part 130, and a second nano-fiber guide part 140.

The solution spinning part 110 may include a syringe 111 and a nozzle 112.

The syringe 111 may contain a spinning solution 10. The spinning solution 10 may be an organic material solution such as polymer or an organic/inorganic mixed solution in which organic and inorganic materials are mixed, and may have a viscosity of about 1 poise to about 200 poise. The nozzle 112 may be connected to the syringe 111, and may spin the spinning solution 10, contained in the syringe 111, in a direction of a stage 120. The nozzle 112 may be formed of a conductive material, for example, a stainless material, and may have a fine tubular shape with a certain inner diameter and a certain outer diameter.

The stage part 120 may be disposed so as to be spaced, by a certain gap, from an end portion of the nozzle 112 from which the spinning solution 10 is spun. The stage part 120 may be formed of a conductive material. The stage part 120 may support a substrate (not shown) on which a pattern is to be formed by a nano-fiber.

Different voltages may be applied to the nozzle 112 and the stage part 120, and thus an electric field may be generated between the nozzle 112 and the stage part 120. When the spinning solution 10 is spun through the nozzle 112, the spinning solution 10 distributed on the tip of the nozzle 112 may have a hemispherical drop shape due to the surface tension, and charges having the same polarity as the voltage applied to the nozzle 112 may be induced to generate an electrostatic repulsion force on the surface of the drop of the spinning solution 10. Due to the action of this electrostatic force, the drop of the spinning solution 10 suspended from the tip of the nozzle 112 may elongate into a conical shape that is known as a Taylor cone. When the intensity of the electric field formed between the nozzle 112 and the stage part 120 becomes larger than the intensity of a specific critical electric field, a jet of the spinning solution 10 may be discharged from the end of the Taylor cone of the spinning solution 10. When the viscosity of the spinning solution 10 is low, the jet of the spinning solution 10 may collapse into fine drops. However, when the viscosity of the spinning solution 10 is higher than or equal to a critical value, the jet of the spinning solution 10 may not collapse due to the surface tension, and may be spun in a direction of stage part 120 in a form of continuous fiber. In this embodiment, since the spinning solution 10 has a viscosity of about 1 poise to about 200 poises, the spinning solution 10 may be spun in a form of fiber. The fiber of the spinning solution 10 discharged from the Taylor cone of the spinning solution 10 may have a diameter of nanoscale. Hereinafter, 'the fiber of the spinning solution 10' discharged from the Taylor cone of the spinning solution 10 will be referred to as a 'nano-fiber' for convenience of explanation. When the volume current density of a nano-fiber is high, bending may occur due to the intrinsic instability of the nano-fiber. The location where the bending of the nano-fiber occurs may be changed by the charged degree of the nano-fiber and the characteristics of a solvent such as viscosity, dielectric permittivity, and conductivity. For example, as the charged degree of the nano-fiber increases, the bending of the nano-fiber may occur at a location closer to the tip of the nozzle 112.

The first and second nano-fiber guide parts 130 and 140 may guide the travel direction of the nano-fiber spun from the nozzle 112. In this case, the first nano-fiber guide part 130 may be disposed between the tip of the nozzle 112 and the stage part 120, and the second nano-fiber guide part 140 may be disposed between the tip of the nozzle 112 and the first nano-fiber guide part 130. The first and second nano-fiber guide parts may transform an electric field formed between the nozzle 112 and the stage part 120, and thus may guide the travel direction of the nano-fiber. In this case, the first and second nano-fiber guide parts 130 and 140 may be formed of a material having a low relative dielectric permittivity. For example, the first and second nano-fiber guide parts 130 and 140 may be formed of a material having a relative dielectric permittivity of about 50 or less. Specifically, the first and second nano-fiber guide parts 130 and 140 may be formed of a material such as polystyrene (e.g., Styrofoam), polytetrafluoroethylene (e.g., Teflon), wood, plastics, glass, quartz, or silicon oxide, but the present invention is not limited thereto. As another example, the first and second nano-fiber guide parts 130 and 140 may be formed of a metallic material.

On the other hand, the first nano-fiber guide part 130 may include a first guide part 131 and a second guide part 132 which are spaced from each other by a certain gap across the extension line of the nozzle 112. The second nano-fiber guide part 140 may include a third guide part 141 and a fourth guide part 142 which are spaced from each other across the extension line of the nozzle 112 and located over the first guide part 131 and the second guide part 132, respectively.

The first and second guide parts 131 and 132 may extend in a direction parallel to the stage part 120, i.e., in Y-axis direction, and may be disposed to be parallel to each other. The first and second guide parts 131 and 132 may have the same shape and size, and the first and second guide parts 131 and 132 may not be limited to a specific shape and may have various kinds of shapes. In an embodiment, the first and second guide parts 131 and 132 may have a rodlike shape having a section of circle, polygon, semi-circle and oval, and may also have a plate shape. For example, the first and second guide parts 131 and 132 may have a rectangular section cut along the XZ plane, and may have a rectangular rodlike shape extending in a direction Y perpendicular to the XZ plane. The first and second guide parts 131 and 132 may transform an electric field formed between the tip of the nozzle 112 and the stage part 120, and thus may form an electric field which applies a force acting in Y-axis direction to the nano-fiber.

The third and fourth guide parts 141 and 142 may extend in Y-axis direction over the first and second guide parts 131 and 132, respectively, and may be disposed to be parallel to each other. When the volume current density of a nano-fiber is high, the degree of intrinsic instability of the nano-fiber becomes high, making it difficult for the nano-fiber to pass between the first and second guide parts 131 and 132. In this case, the third and fourth guide parts 141 and 142 may transform the electric field between the tip of the nozzle 112 and the stage part 120, and thus may guide the nano-fiber such that the nano-fiber passes between first and second guide parts 131 and 132.

The third and fourth guide parts 141 and 142 may have the same shape and size, and the third and fourth guide parts 141 and 142 may not be limited to a specific shape and may have various kinds of shapes. In an embodiment, the third and fourth guide parts 141 and 142 may have a rodlike shape having a section of circle, polygon, semi-circle and oval, and may also have a plate shape. For example, the third and fourth guide parts 141 and 142 may have a rectangular section cut along the XZ plane, and may have a rectangular rodlike shape extending in a direction Y perpendicular to the XZ plane. In this case, the widths of the third and fourth guide parts 141 and 142 in X-axis direction may be smaller than the widths of the first and second guide parts 131 and 132 in X-axis direction, respectively. Accordingly, the distance D2 between the third guide part 141 and the fourth guide part 142 may be larger than the distance D1 between the first guide part 131 and the second guide part 132.

Also, in order to stably guide the nano-fiber to a space between the first guide part 131 and the second guide part 132, the upper surfaces of the third guide part 141 and the fourth guide part 142 may be located higher than a point where bending of the nano-fiber occurs. In an embodiment, when the point where bending of nano-fiber occurs is spaced from the tip of the nozzle 112, e.g., by about less than 2 cm, the upper surfaces of the third and fourth guide parts 141 and 142 may be disposed at a higher location than the tip of the nozzle 112, and when the point where bending of nano-fiber occurs is spaced from the tip of the nozzle 112 by about 2 cm or more, the upper surfaces of the third and fourth guide parts 141 and 142 may be disposed at a lower location than the tip of the nozzle 112.

The electro-spinning type pattern forming apparatus 100 may further include a first position control part (not shown) and a second position control part (not shown). The first position control part may move the first nano-fiber guide part 130 in up-and-down and left-and-right directions. Also, the second position control part may move the second nano-fiber guide part 140 in up-and-down and left-and-right directions independently of the first nano-fiber guide part 130. The first and second position control parts may adjust the heights of the first and second nano-fiber guide parts 130 and 140, the distance D1 between the first guide part 131 and the second guide part 132, the distance D2 between the third guide part 141 and the fourth guide part 142, and the space S between the first nano-fiber guide part 130 and the second nano-fiber guide part 140 according to the need.

Figure 13A:
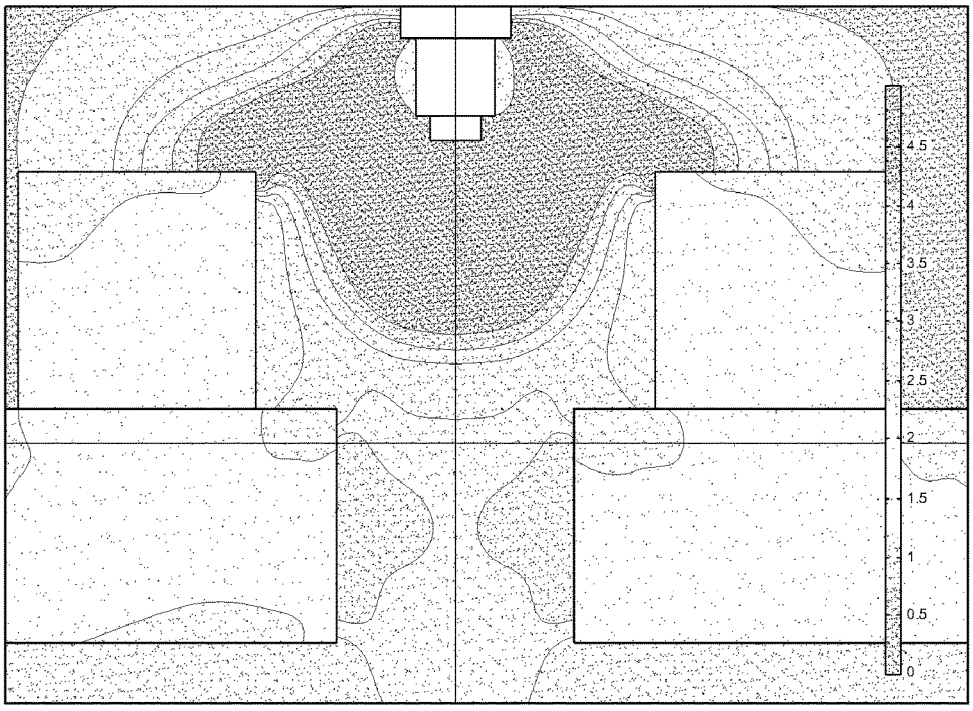
FIGS. 13A and 13B are a photograph and a graph illustrating the intensity of a Z-component electric field according to the position of X-axis, in a first electro-spinning type pattern forming apparatus including both a first nano-fiber guide part and a second nano-fiber guide part, respectively.
Figure 13B:
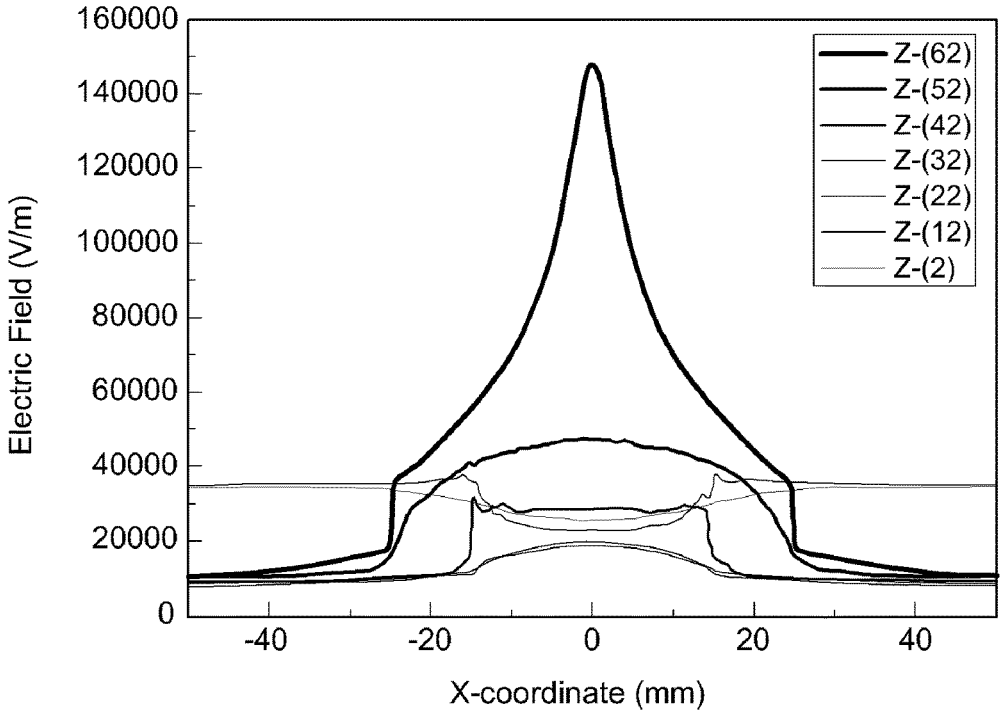
Figure 14A:
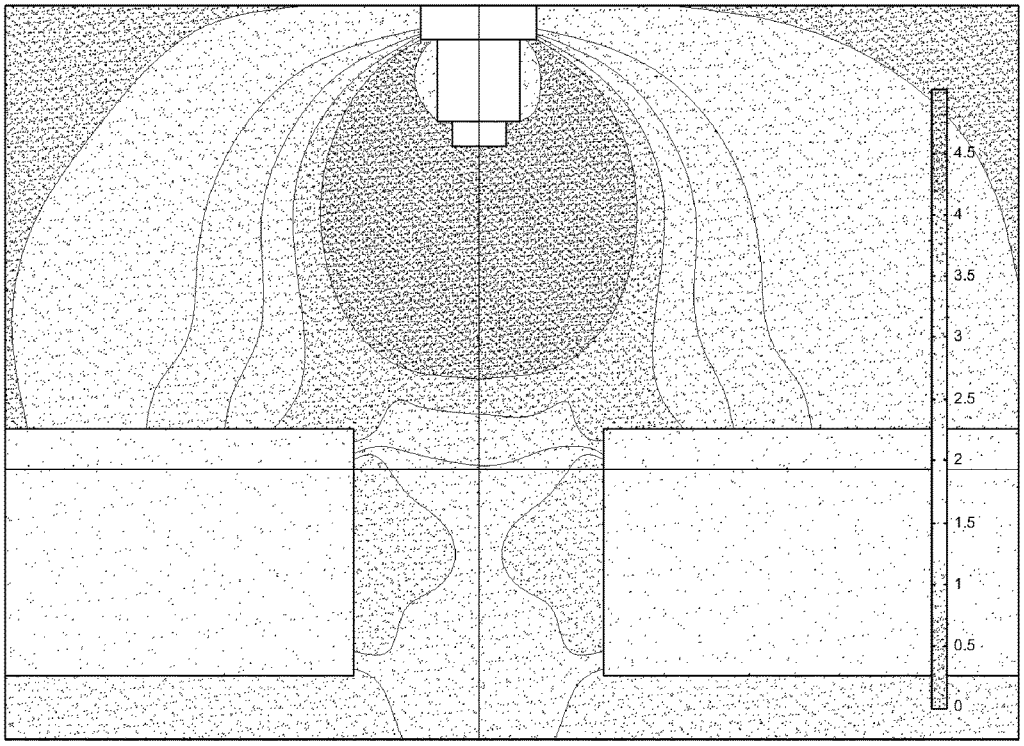
FIGS. 14A and 14B are a photograph and a graph illustrating the intensity of a Z-component electric field according to the position of X-axis, in a second electro-spinning type pattern forming apparatus including only a first nano-fiber guide part among the first nano-fiber guide part and a second nano-fiber guide part, respectively.

FIGS. 13A and 13B are a photograph and a graph illustrating the intensity of a Z-component electric field according to the position of X-axis, in a first electro-spinning type pattern forming apparatus including both a first nano-fiber guide part and a second nano-fiber guide part, respectively. Also, FIGS. 14A and 14B are a photograph and a graph illustrating the intensity of a Z-component electric field according to the position of X-axis, in a second electro-spinning type pattern forming apparatus including only a first nano-fiber guide part among the first nano-fiber guide part and a second nano-fiber guide part, respectively.

Figure 14B:
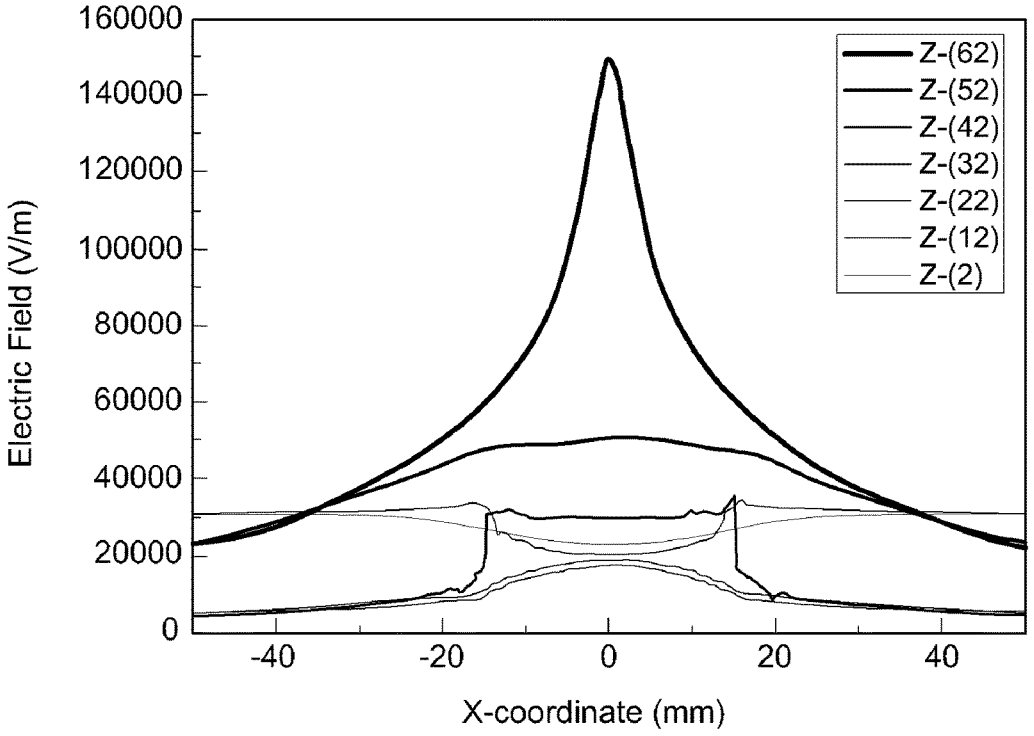

In FIGS. 13A, 13B, 14A, and 14B, Y-coordinate may indicate a distance (mm) to the extending direction of the first to fourth guide parts 131, 132, 141 and 142, and X-coordinate may indicate a distance (mm) to a direction parallel to the stage part 120 and perpendicular to Y-axis. Also, Z-coordinate may indicate a distance (mm) to a direction perpendicular to X-axis and Y-axis. A point where X-coordinate and Y-coordinate are zero may be located on the extension line of the nozzle 112, and a point where Z-coordinate is zero may be located on the upper surface of the stage part 120. The distance D1 between the first guide part 131 and the second guide part 132 may be about 30 mm, and the distance D2 between the third guide part 141 and the fourth guide part 142 may be about 50 mm. The distance from the upper surface of the stage part 120 to the tip of the nozzle 112 may be about 65 mm. Also, the distance from the upper surface of the stage part 120 to the lower surfaces of the first and second guide parts 131 and 132 may be about 14 mm, and the Z-axis thickness of the first and second guide parts 131 and 132 and the third and fourth guide parts may be about 30 mm and 30 mm, respectively. In FIGS. 13B and 14B, the black curve, red curve, blue curve, blue-green curve, pink curve, yellowish brown curve, and navy blue curve may indicate the intensities of electric field along X-coordinate at points where Z-coordinates are '62', '52', '42', '32', '22', '12' and '2', respectively.

Referring to FIGS. 13A, 13B, 14A, and 14B together with FIG. 12, it can be seen that the electric field in the first electro-spinning type pattern forming apparatus is different from the electric field of the second electro-spinning type pattern forming apparatus. Particularly, the black curve and red curve in regard to the first electro-spinning type pattern forming apparatus may be equal or similar, in peak value, to the black curve and red curve of the second electro-spinning type pattern forming apparatus. However, in a region between the third guide part 141 and the fourth guide part 142, i.e., a region where X-coordinate is equal to or larger than '−25' and equal to or less than '+25', it can be seen that the intensity of electric field is shown as significantly high compared to other regions. That is, in case of black curve and red curve in the first electro-spinning type pattern forming apparatus, it can be seen that the intensity of electric field is significantly reduced in the region where X-coordinate is less than '−25' and more than '+25' by the third and fourth guide parts 141 and 142.

This means that at a location between the first nano-fiber guide part 130 and tip of the nozzle 112, the electric field formed by the first electro-spinning type pattern forming apparatus compared to the electric field formed by the second electro-spinning type pattern forming apparatus concentrates the movement of the nano-fiber in the center direction and thus can reduce the movement of the nano-fiber in X-axis direction by bending of the nano-fiber. Consequently, in the first electro-spinning type pattern forming apparatus compared to the second electro-spinning type pattern forming apparatus, the movement of the nano-fiber in X-axis direction may be reduced by the third guide part 141 and the fourth guide part 142, and thus the nano-fiber may be more stably guided to a space between the first guide part 131 and the second guide part 132.

Figure 15A:
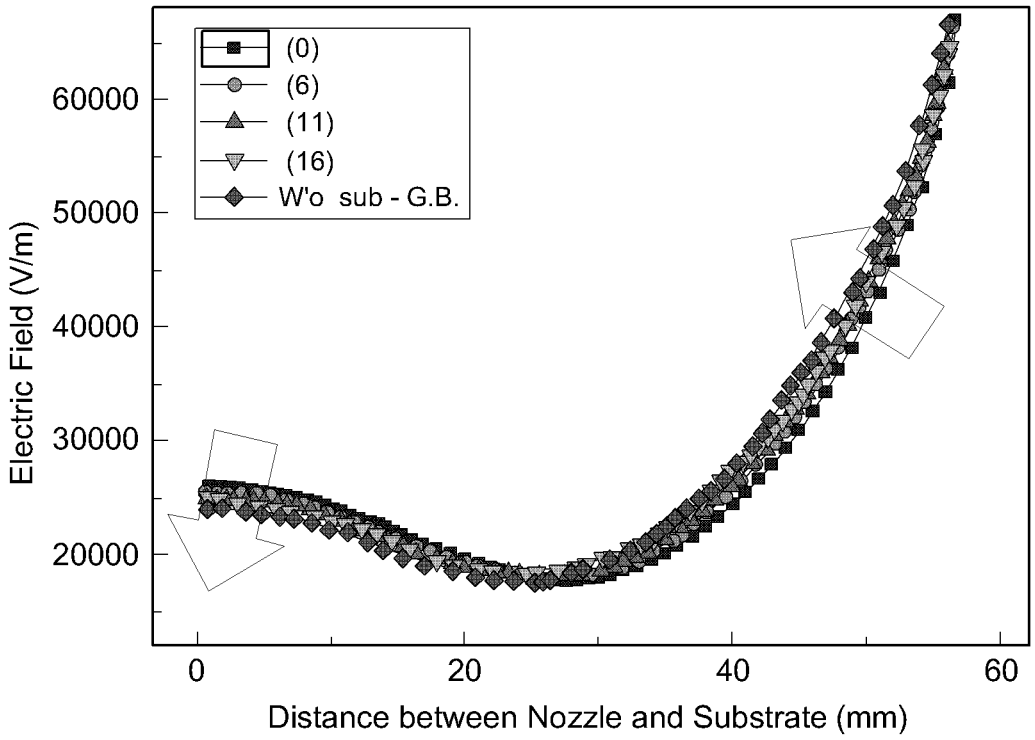
FIG. 15A is a graph illustrating the intensity of a Z-component electric field according to a distance (Z-coordinate) in a Z-axis direction at a point where X-coordinate and Y-coordinate are zero when a vertical distance (S) between an upper surface of a first nano-fiber guide part and a lower surface of a second nano-fiber guide part is changed.
Figure 15B:
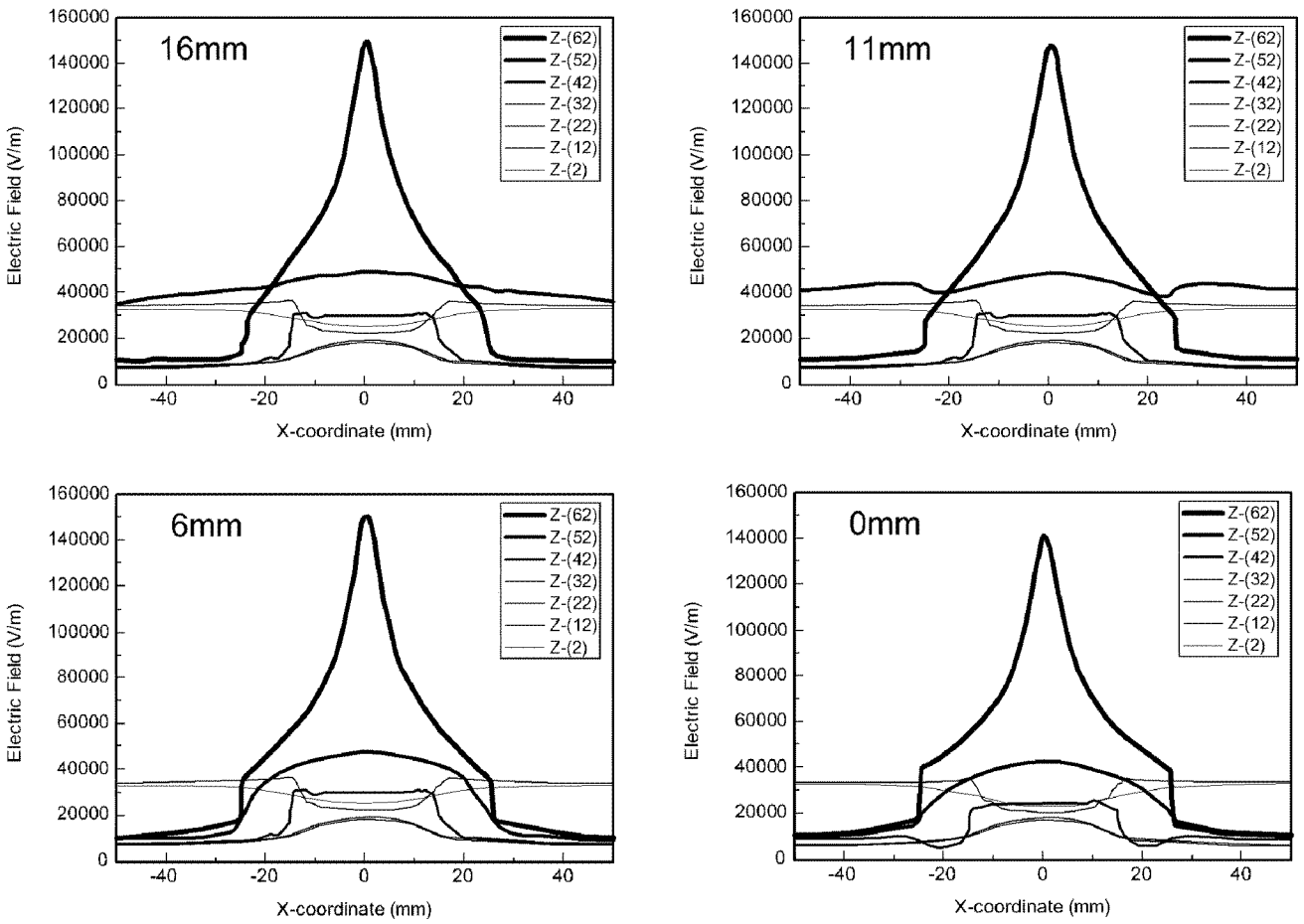
FIG. 15B is graphs illustrating the intensities of Z-component electric field according to the position of X-axis when vertical distances between an upper surface of a first nano-fiber guide part and a lower surface of a second nano-fiber guide part are 16 mm, 11 mm, 6 mm, and 0 mm, respectively.

FIG. 15A is a graph illustrating the intensity of a Z-component electric field according to a distance (Z-coordinate) in a Z-axis direction at a point where X-coordinate and Y-coordinate are zero when a vertical distance (S) between an upper surface of a first nano-fiber guide part and a lower surface of a second nano-fiber guide part is changed, and FIG. 15B is graphs illustrating the intensities of Z-component electric field according to the position of X-axis when vertical distances between an upper surface of a first nano-fiber guide part and a lower surface of a second nano-fiber guide part are 16 mm, 11 mm, 6 mm, and 0 mm, respectively.

In FIG. 15A, the black curve, the red curve, the blue curve, and the green curve may indicate the intensity of electric field when a vertical space S between the upper surface of the first nano-fiber guide part 130 and the lower surface of the second nano-fiber guide part 140 is 0 mm, 6 mm, 11 mm, or 16 mm, respectively, in the electro-spinning type pattern forming apparatus including both first nano-fiber guide part 130 and second nano-fiber guide part 140. Also, the pink curve may indicate the intensity of electric field in the electro-spinning type pattern forming apparatus including only the first nano-fiber guide part 130 among the first nano-fiber guide part 130 and the second nano-fiber guide part 140.

On the other hand, in FIG. 15B, the black curve, red curve, blue curve, blue-green curve, pink curve, yellowish brown curve, and navy blue curve may indicate the intensities of electric field along X-coordinate at points where Z-coordinates are '62', '52', '42', '32', '22', '12' and '2', respectively.

Referring to FIG. 15A together with FIG. 12, the intensity of the Z-component electric field in the pink curve may be largest at a region between the first nano-fiber guide part 130 and the tip of the nozzle 112, i.e., a location where Z-coordinate is equal to or larger than 40 and equal to or smaller than 60, and the intensity of the Z-component electric field in the black curve may be smallest. Specifically, in case of the electro-spinning type pattern forming apparatus including both first nano-fiber guide part 130 and the second nano-fiber guide part 140, as the vertical space S between the upper surface of the first nano-fiber guide part 130 and the lower surface of the second nano-fiber guide part 140 increases, the intensity of the Z-component electric field may increase at the region between the first nano-fiber guide part 130 and the tip of the nozzle 112.

On the other hand, the intensity of the Z-component electric field in the black curve may be largest at a region between the first nano-fiber guide part 130 and the stage part 120, i.e., a location where Z-coordinate is equal to or larger than 0 and equal to or smaller than 10, and the intensity of the Z-component electric field in the pink curve and orange curve may be smallest. Specifically, in case of the electro-spinning type pattern forming apparatus including both first nano-fiber guide part 130 and the second nano-fiber guide part 140, as the vertical space S between the upper surface of the first nano-fiber guide part 130 and the lower surface of the second nano-fiber guide part 140 decreases, the intensity of the Z-component electric field may increase at the region between the first nano-fiber guide part 130 and the stage part 120.

Referring to FIG. 15B together with FIG. 12, in the electro-spinning type pattern forming apparatus including both first nano-fiber guide part 130 and the second nano-fiber guide part 140, when the vertical space S between the upper surface of the first nano-fiber guide part 130 and the lower surface of the second nano-fiber guide part 140 is changed, the change of the red curve indicating the intensity of the electric field at a height where the second nano-fiber guide part 140 is located may be greatest. Specifically, in the red curve, when the vertical space S between the upper surface of the first nano-fiber guide part 130 and the lower surface of the second nano-fiber guide part 140 is '0 mm' and '6 mm', the intensity of electric field at a region where X-coordinate ranges from '−25' to '+25', i.e., between the third guide part 141 and the fourth guide part 142 may be significantly high compared to other regions. However, the vertical space S between the upper surface of the first nano-fiber guide part 130 and the lower surface of the second nano-fiber guide part 140 is '11 mm' and '16 mm', the intensity of electric field at the region where X-coordinate ranges from '−25' to '+25' may not be significantly different from the intensities of electric field at other regions.

Thus, in order to pass a nano-fiber through a region between the first guide part 131 and the second guide part 132 of the first nano-fiber guide part 130, the vertical space S between the upper surface of the first nano-fiber guide part 130 and the lower surface of the second nano-fiber guide part 140 may be set to about 10 mm or less, more preferably, to about 8 mm or less.

Figure 16A:
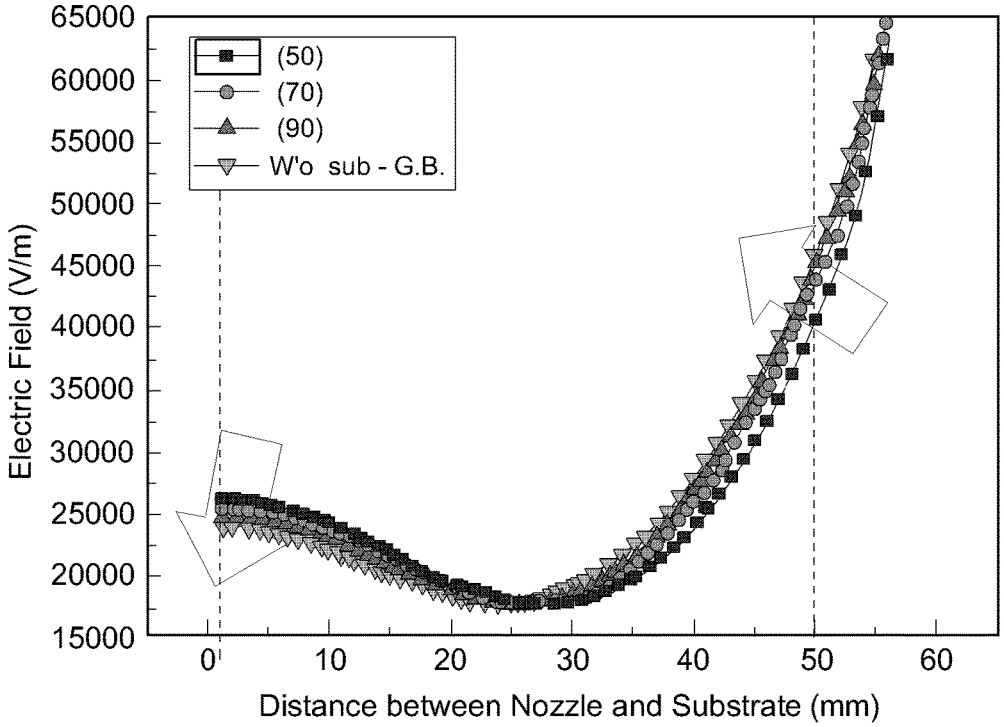
FIG. 16A is a graph illustrating the intensity of a Z-component electric field according to a distance (Z-coordinate) in a Z-axis direction at a point where X-coordinate and Y-coordinate are zero when a horizontal distance between a third nano-fiber guide part and a fourth nano-fiber guide part is changed.
Figure 16B:
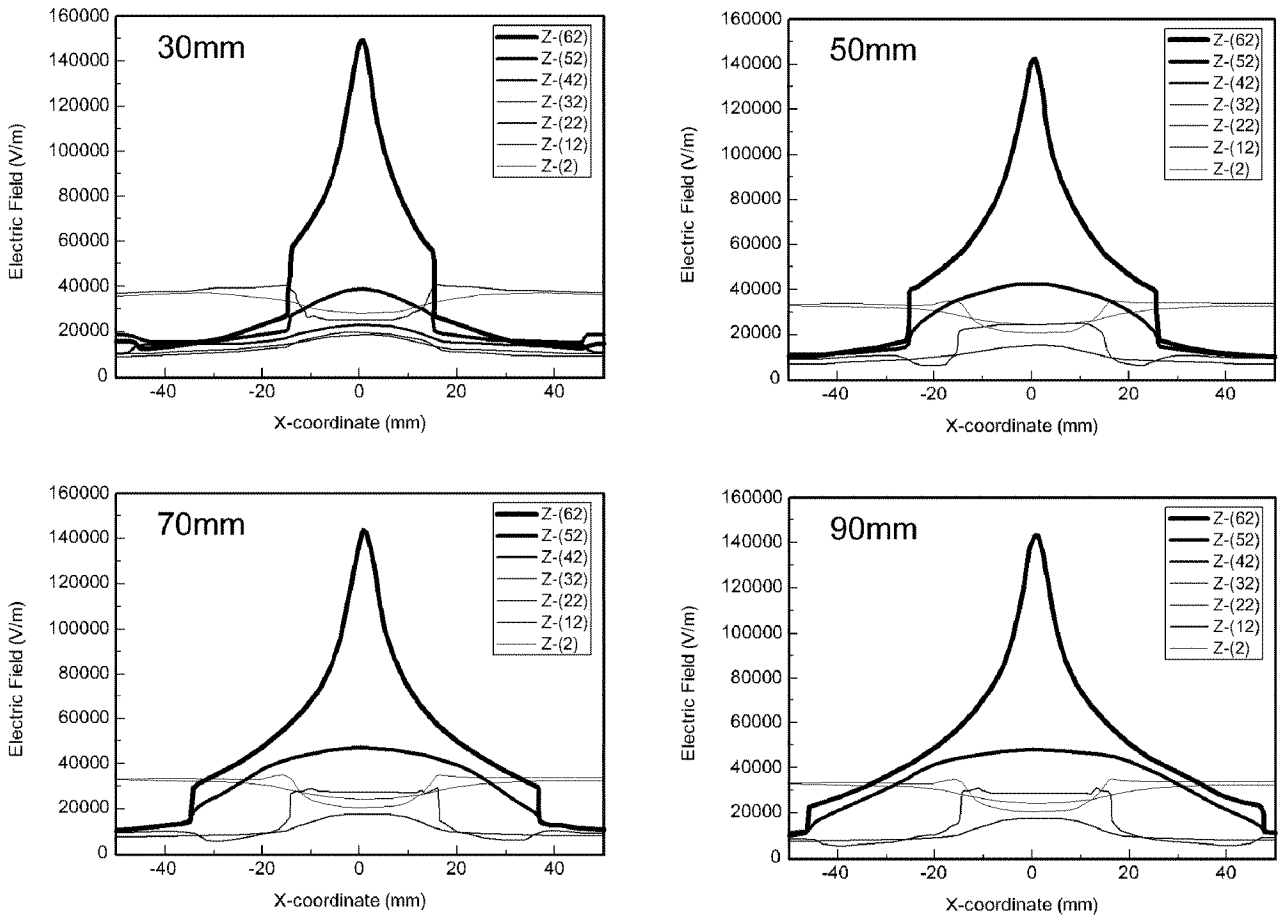
FIG. 16B is graphs illustrating the intensities of Z-component electric field according to the position of X-axis when horizontal distances between a third nano-fiber guide part and a fourth nano-fiber guide part are 30 mm, 50 mm, 70 mm, and 90 mm, respectively.

FIG. 16A is a graph illustrating the intensity of a Z-component electric field according to a distance (Z-coordinate) in a Z-axis direction at a point where X-coordinate and Y-coordinate are zero when a horizontal distance between a third nano-fiber guide part and a fourth nano-fiber guide part is changed, and FIG. 16B is graphs illustrating the intensities of Z-component electric field according to the position of X-axis when horizontal distances between a third nano-fiber guide part and a fourth nano-fiber guide part are 30 mm, 50 mm, 70 mm, and 90 mm, respectively.

In FIG. 16A, the distance D1 between the first guide part 131 and the second guide part 132 of the first nano-fiber guide part 130 may be about '30 mm'. The black curve, the red curve, and the blue curve may indicate the intensities of electric field when the horizontal distance D2 between the third guide part 141 and the fourth guide part 142 is '50 mm', '70 mm', or '90 mm', respectively, in the electro-spinning type pattern forming apparatus including both first nano-fiber guide part 130 and second nano-fiber guide part 140. Also, the green curve may indicate the intensity of electric field in the electro-spinning type pattern forming apparatus including only the first nano-fiber guide part 130 among the first nano-fiber guide part 130 and the second nano-fiber guide part 140.

In FIG. 16B, the black curve, red curve, blue curve, blue-green curve, pink curve, yellowish brown curve, and navy blue curve may indicate the intensities of electric field along X-coordinate at points where Z-coordinates are '62', '52', '42', '32', '22', '12' and '2', respectively.

Referring to FIG. 16A together with FIG. 12, the intensity of the Z-component electric field in the green curve may be largest at a location where Z-coordinate is equal to or larger than 30, and the intensity of the Z-component electric field in the black curve may be smallest. Specifically, in case of the electro-spinning type pattern forming apparatus including both first nano-fiber guide part 130 and the second nano-fiber guide part 140, as the horizontal distance D2 between the third guide part 141 and the fourth guide part 142 increases, the intensity of the Z-component electric field may increase at the region where Z-coordinate is equal to or larger than 30.

On the other hand, at a region where Z-coordinate is equal to or larger than 0 and equal to or less than 15, the intensity of the Z-component electric field in the black curve may be largest, and the intensity of the Z-component electric field in the green curve may be smallest. Specifically, in case of the electro-spinning type pattern forming apparatus including both first nano-fiber guide part 130 and the second nano-fiber guide part 140, as the horizontal distance D2 between the third guide part 141 and the fourth guide part 142 decreases, the intensity of the Z-component electric field may increase at the region where Z-coordinate is equal to or less than 15.

Referring to FIG. 16B together with FIG. 12, when the horizontal distance D2 between the third guide part 141 and the fourth guide part 142 is '30 mm', i.e., when the horizontal distance D2 between the third guide part 141 and the fourth guide part 142 is equal to the horizontal distance D1 between the first guide part 131 and the second guide part 132, the peak value of the intensity of electric field in the red curve may be significantly low compared to other cases. On the other hand, when the horizontal distance D2 between the third guide part 141 and the fourth guide part 142 is '90 mm', i.e., when the horizontal distance D2 between the third guide part 141 and the fourth guide part 142 is excessively larger than the horizontal distance D1 between the first guide part 131 and the second guide part 132, there may be a limitation in that even a nano-fiber guided by the third and fourth guide parts 141 and 142 is difficult to pass the space between first guide part 131 and the second guide part 132.

Thus, when the horizontal distance D1 between the first guide part 131 and the second guide part 132 may be about 30 mm, it may be desirable that the horizontal distance D2 between the third guide part 141 and the fourth guide part 142 is equal to or larger than about 40 mm and equal to or less than about 80 mm. In other words, the horizontal distance D2 between the third guide part 141 and the fourth guide part 142 may be about 4/3 times to about 8/3 times larger than the horizontal distance D1 between the first guide part 131 and the second guide part 132.

INDUSTRIAL APPLICABILITY

According to embodiments, an electric field applying a force in a direction parallel to the extension direction of a fiber guide part to a nano-fiber may be formed using the fiber guide part, and nano-fibers can be arranged and located in one direction on a substrate, thereby forming a microscale pattern at a predetermined location on the substrate.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

The invention claimed is:

1. An electro-spinning type pattern forming apparatus comprising:

a nozzle having a first voltage applied thereto and spinning a spinning solution;

a stage disposed under the nozzle to support a substrate on which a pattern is to be formed and having a second voltage applied thereto; and a fiber guide part having a first guide part and a second guide part isolated from each other, wherein, the first guide part and the second guide part are disposed between the nozzle and the stage; the first guide part and the second guide part are symmetrically disposed with respect to a virtual extension line extending from an end portion of the nozzle to the stage; the first guide part and the second guide part have a shape which is extended in a direction perpendicular to the virtual extension line; and the first guide part and the second guide part are formed of a material having a relative dielectric permittivity of 50 or less, so that an electric field formed between the nozzle and the stage is able to be modified in order to apply a force, in a direction parallel to the stage, to a nano-fiber spun from the nozzle.

2. The electro-spinning type pattern forming apparatus of claim 1, wherein the first and second guide parts are formed of one or more selected from the group consisting of polystyrene, polytetrafluoroethylene, wood, plastics, glass, quartz, and silicon oxide.

3. The electro-spinning type pattern forming apparatus of claim 1, wherein the first guide part and the second guide part have a thickness larger than about 5 mm in the extension line direction, respectively.

4. The electro-spinning type pattern forming apparatus of claim 3, wherein the first guide part and the second guide part have a thickness equal to or larger than about 10 mm, respectively.

5. The electro-spinning type pattern forming apparatus of claim 1, wherein the first guide part and the second guide part have a thickness ranging from about 10 mm to about 70 mm in the extension direction, respectively.

6. An electro-spinning type pattern forming apparatus comprising:

a nozzle having a first voltage applied thereto and spinning a spinning solution;

a stage disposed under the nozzle to support a substrate on which a pattern is to be formed and having a second voltage applied thereto; and a fiber guide part disposed between the nozzle and the stage and transforming an electric field formed between the nozzle and the stage to apply a force, acting in a direction parallel to the stage, to a nano-fiber spun from the nozzle, wherein the fiber guide part comprises first and second guide parts which are symmetrically disposed parallel to each other based on a virtual extension line extending in a vertical direction from an end portion of the nozzle to the stage and extend in a direction perpendicular to the extension line, and the first and second guide parts have a rectangular rod shape which has a thickness larger than about 5 mm in a direction of the extension line and has a length ranging from about 10 mm to about 70 mm in the extension direction of the first and second guide parts, the first and second guide parts being formed of a metal, respectively.

7. An electro-spinning type pattern forming apparatus comprising:

a nozzle having a first voltage applied thereto and spinning a nano-fiber from a spinning solution;

a stage part disposed under the nozzle to support a substrate on which a pattern is to be formed and having a second voltage different from the first voltage applied thereto;

a first nano-fiber guide part comprising a first guide part and a second guide part spaced from each other across an extension line of the nozzle between the nozzle and the stage part and transforming an electric field formed between the nozzle and the stage part to arrange the nano-fiber in a direction corresponding to a region between the first and second guide parts; and a second nano-fiber guide part comprising a third guide part and a fourth guide part disposed over the first guide part and the second guide part, respectively, and spaced from each other, and transforming an electric field formed between the nozzle and the stage part to guide the nano-fiber to a region between the first and second guide parts, wherein the first guide part and the second guide part extend in a first direction across a virtual extension line extending perpendicularly to the stage part from the nozzle, respectively; the third guide part and the fourth guide part extend in the first direction across the virtual extension line, respectively; and the first guide part, the second guide part, the third guide part, and the fourth guide part are formed of a material having a relative dielectric permittivity of 50 or less, respectively.

8. The electro-spinning type pattern forming apparatus of claim 7, wherein the first and second guide parts and the third and fourth guide parts are formed of one or more selected from the group consisting of polystyrene, polytetrafluoroethylene, wood, plastics, glass, quartz, silicon oxide, and metal.

9. The electro-spinning type pattern forming apparatus of claim 7, wherein upper surfaces of the first and second guide parts and lower surfaces of the third and fourth guide parts make contact with each other or are spaced from each other by a gap of about 10 mm or less.

10. The electro-spinning type pattern forming apparatus of claim 7, wherein a first distance between the first guide part and the second guide part is smaller than a second distance between the third guide part and the fourth guide part.

11. The electro-spinning type pattern forming apparatus of claim 10, wherein the second distance is larger about 4/3 times to about 8/3 times than the first distance.

12. The electro-spinning type pattern forming apparatus of claim 7, further comprising:

a first position control part moving the first nano-fiber guide part; and a second position control part moving the second nano-fiber guide part independently of the first nano-fiber guide part.

* * * * *